US008635824B2

(12) United States Patent
Scherrer

(10) Patent No.: US 8,635,824 B2
(45) Date of Patent: Jan. 28, 2014

(54) INSULATION PANEL SYSTEM

(76) Inventor: Edward G. Scherrer, Hugo, MN (US)

( * ) Notice: Subject to any disclaimer, the term of this patent is extended or adjusted under 35 U.S.C. 154(b) by 5 days.

(21) Appl. No.: 12/971,704

(22) Filed: Dec. 17, 2010

(65) Prior Publication Data

US 2011/0252728 A1 Oct. 20, 2011

Related U.S. Application Data

(63) Continuation-in-part of application No. 11/654,194, filed on Jan. 17, 2007, now abandoned.

(51) Int. Cl.

| | |
|---|---|
| ***E04C 1/00*** | (2006.01) |
| ***E04C 3/30*** | (2006.01) |
| ***E04B 2/00*** | (2006.01) |

(52) U.S. Cl.

USPC ..... 52/309.5; 52/309.4; 52/309.7; 52/307.16; 52/422; 52/435; 52/506.01

(58) Field of Classification Search

USPC ..... 52/798.1, 800.1, 309.4, 309.5, 309.7, 52/309.11, 309.16, 415–445, 474–489.2, 52/762–761, 506.01–541

See application file for complete search history.

(56) References Cited

U.S. PATENT DOCUMENTS

| | | | | |
|---|---|---|---|---|
| 2,169,254 | A | | 8/1939 | Kotrbaty |
| 2,205,725 | A | | 6/1940 | Kavanagh |
| 2,777,318 | A | | 1/1957 | Kinsman |
| 2,836,266 | A | | 5/1958 | Leeser |
| 2,950,575 | A | | 8/1960 | Hellwig |
| 3,062,337 | A | | 11/1962 | Zittle |
| 3,357,146 | A | * | 12/1967 | Gartrell ..... 52/592.4 |
| 3,362,120 | A | | 1/1968 | Warren |
| 3,979,867 | A | | 9/1976 | Sowinski |
| 4,163,349 | A | | 8/1979 | Smith |
| 4,244,151 | A | | 1/1981 | Seem |
| 4,288,962 | A | | 9/1981 | Kavanaugh |
| 4,333,290 | A | | 6/1982 | Koberstein |
| 4,375,741 | A | | 3/1983 | Paliwoda |
| 4,375,742 | A | | 3/1983 | Paliwoda |
| 4,429,503 | A | | 2/1984 | Holliday |
| 4,494,348 | A | | 1/1985 | Kastelic |
| 4,495,741 | A | | 1/1985 | Pasiecznik |
| 4,574,549 | A | | 3/1986 | Holcombe |
| 4,625,486 | A | | 12/1986 | Dickinson |
| 4,637,187 | A | | 1/1987 | Campbell |
| 4,769,963 | A | | 9/1988 | Meyerson |
| 4,811,537 | A | | 3/1989 | D'Epenoux |
| 4,862,660 | A | | 9/1989 | Raymond |
| 4,953,334 | A | | 9/1990 | Dickens |
| 5,279,089 | A | | 1/1994 | Gulur |
| 5,279,091 | A | | 1/1994 | Williams et al. |

(Continued)

*Primary Examiner* — Andrew Triggs

(74) *Attorney, Agent, or Firm* — Merchant & Gould PC

(57) ABSTRACT

A wall system includes a first wall section a structural portion, such as concrete block construction. A second wall section mounts to the first wall section and includes insulating panels connected in an edge to edge relationship to form a continuous insulating layer. A third wall section of conventional finishing materials such as drywall, paneling or exterior finish layer mounts over the second wall section. Each of the insulating panels includes mounting elements at least partially embedded therein that provide for mounting the panels to the first layer and for mounting the third wall section to the second wall section. Each of the panels is lightweight and may be water impervious. The panels have ridges formed therein that define channels for routing wiring and other components. The panels also include complementary edges and complementary alignment features.

38 Claims, 56 Drawing Sheets

(56) References Cited

U.S. PATENT DOCUMENTS

| | | | | |
|---|---|---|---|---|
| 5,758,464 | A | 6/1998 | Hatton | |
| 5,822,940 | A | 10/1998 | Carlin et al. | |
| 5,893,248 | A | 4/1999 | Beliveau | |
| 6,073,410 | A | 6/2000 | Schimpf et al. | |
| 6,076,315 | A | 6/2000 | Kondo | |
| 6,526,710 | B1 | 3/2003 | Killen | |
| 6,629,392 | B1 | 10/2003 | Harrel et al. | |
| 6,725,616 | B1 | 4/2004 | Pease | |
| 6,892,507 | B1 | 5/2005 | Pease | |
| 7,032,356 | B2 | 4/2006 | Layfield | |
| 7,543,419 | B2 * | 6/2009 | Rue | 52/630 |
| 7,670,527 | B2 * | 3/2010 | Malis | 264/261 |
| 7,963,080 | B1 * | 6/2011 | Bowman | 52/414 |
| 8,046,971 | B2 | 11/2011 | Lima | |
| 2003/0140588 | A1 | 7/2003 | Sucato, Jr. | |
| 2003/0140592 | A1 | 7/2003 | Fjeld | |
| 2005/0204697 | A1 | 9/2005 | Rue | |
| 2005/0223669 | A1 | 10/2005 | Cymbala et al. | |
| 2008/0168728 | A1 * | 7/2008 | Scherrer | 52/309.11 |
| 2011/0252728 | A1 * | 10/2011 | Scherrer | 52/220.1 |

* cited by examiner 16
24
16
24
16
24

INSULATION PANEL SYSTEM

BACKGROUND OF THE INVENTION

1. Field of the Invention

The present invention is directed to an insulation system and in particular to a finishing system having insulating panels fitted together for mounting onto masonry, concrete, structural or framed walls or other building structures.

2. Description of the Prior Art

Conventional wall systems for basements and other applications wherein a masonry, concrete modular unit (CMU) or poured concrete wall is used have traditional framed construction with wood studs and fiberglass insulation placed against the concrete block or other masonry between the studs. Such construction systems are well known and utilized widely.

Although such systems are proven to be suitable and often provide satisfactory finishing, such systems have several drawbacks. Installation may be difficult with studs mounting to a concrete wall. The studs may warp or twist and may cause the nails to protrude back through drywall. The wood studs are prone to mold, moisture damage and rot and require an additional vapor barrier. Although insulation may be placed between the studs, the studs themselves are still a thermal conductor. Steel studs are an alternative, but generally prove difficult for the average homeowner to install, require special mounting and suffer from high thermal conductivity and rusting.

Fiberglass insulation is also susceptible to water damage and mold if moisture is present. The thickness required for adequate insulation may decrease the overall size of the room due to the added depth of the wall. Fiberglass insulation is difficult to handle and requires special gloves and a respirator. Foam types of insulation are often open cell material that allows moisture to pass through and may retain some moisture.

Common stud and rolled insulation systems also suffer from difficult installation for wiring, switches, tubing and other components. Conventional construction requires drilling through the studs for routing wiring and/or tubing along the wall.

To overcome the problems associated with common stud construction, systems have been developed to provide an insulation layer. Such systems typically use panels that may attach to one another. Some panels may include metal studs formed therein to allow for mounting. Although such systems do provide advantages in many applications over traditional construction, these systems suffer from their own disadvantages. Such systems require unwieldy, large panels and do not provide alignment along all edges. In addition, such systems do not provide for quick and simple mounting using traditional techniques such as screws or glue strips. Moreover, such systems do not provide for drains or channels to allow water to easily drain without passing through to the inner side of the panels. Such systems also do not provide for easily routing wiring, tubing and other elements that are installed.

It can be seen then that a new and improved insulation system is needed. Such a system should provide simple, lightweight, inexpensive and easy to install construction. In addition, such a system should provide for easily routing tubing, wiring and other components into the wall or other structure. Thermally conductive elements extending at select points through the insulation layer should be eliminated to provide improved insulation over the entire area. Mounting of drywall, paneling or other layers should be easily accomplished. In addition to insulation, a moisture barrier should be created that directs water and moisture away from the outer faces of the layer. The present invention addresses these problems, as well as others associated with insulation systems.

SUMMARY OF THE INVENTION

The present invention is directed to a wall system and in particular to a wall finishing system suitable for concrete, CMU, masonry and other similar wall construction. The present invention utilizes foam insulating panels that are connected to form an intermediate wall layer. The panels include mounting stud type elements molded into the panels to reduce cost and to eliminate problems associated with traditional wood frame construction with rolled fiberglass insulation.

According to the present invention, a load bearing or structural wall portion such as concrete blocks or other masonry as is often found in basements of many homes is covered by an insulating layer and then an inner finishing layer that may be painted, wallpapered, paneled or finished in other well known techniques. The panels have molded in mounting elements that are spaced apart the same distance as standard wood studs and allow for fastening with glue and conventional hardware to the structural wall. The mounting elements also provide for attachment of drywall, wood paneling and other inner finishing type layers to the insulating panel layer.

The panels are generally made of water impervious foam material so that the panels are lightweight and easily transported. In typical embodiments, the panels are 2 feet×4 feet or 16 inches by 4 feet, allowing for easily carrying the panels down stairways. The panels have a tongue and groove configuration along the edges for connecting to adjacent panels both vertically and horizontally to create a continuous insulating layer for an entire wall. The panels include alignment tabs and complementary notches along the top and bottom edges to ensure a proper engagement and placement.

The panels also have ridges formed on at least one face that define channels or chases for routing wiring, tubing or other elements. The parallel ridges extend vertically substantially across the height of the panels leaving only a small strip along the edges so that when panels are connected in an edge to edge relationship, a channel or chase is formed horizontally along adjacent panels between the ends of the ridges of adjacent panels. With this configuration, wiring and other elements may be routed both horizontally and vertically along the width and height of a wall without having to modify the panels. The channels may also direct water away from other wall layers. The edges of the panels also have drainage channels so that water and moisture are directed back toward each face of the panel keeping water from migrating through the panel in either direction. The panels also include cutting channels so that clean, straight cuts may be simply and quickly made so that the panels have clean straight edges.

The panel system is also compatible for soil gas removal systems. The panel channels also provide spaces for ventilation and can be used with fans to remove radon and other soil gases in an active removal system.

The mounting elements are molded into the panels in an embedded configuration in one embodiment. In one embodiment, the mounting elements are generally elongate members with a somewhat "H" shaped cross-sectional profile. The first portion extends perpendicularly outward both its center, which abuts a series of center connecting ribs. The second portion extends from an opposite end of the connecting ribs in a substantially perpendicular configuration with a very slight obtuse "V" shaped profile. The first portion extends to a first face of the panel or just below the first face and includes a channel or channels to receive and recess screw heads used to attach other wall layers to the panels. The second portion also extends to a second face of the panel and includes glue channels on each outward extending leg and a center channel and also provides for receiving adhesive type materials. The panels are glued to a structural wall with proper known adhesives. The mounting elements are preferably molded of plastic material that is impervious to rusting and other deterioration and that can provide a foundation for attaching mounting hardware and also provide support for the panel.

The wall system is easily installed. Preparations may require upgrading the floor to ensure that there is adequate drainage and to accommodate needs for ventilating gases and/or perimeter drainage. The panels are then typically installed by gluing or conventional mechanical fasteners to the load bearing wall, such as poured concrete, concrete masonry unit construction or traditional framing. Panels are placed starting in one corner and working horizontally across the width of a wall. The tongues and grooves form connections between adjacent panels so that a continuous nearly water impervious layer is achieved. The panels are typically offset relative to adjacent panels above and below, but are correctly positioned and spaced with the alignment tabs and notches. Construction of the insulating layer continues in a row by row configuration until reaching the top of the wall. The panels may be trimmed to remove the tongue and grooves from the edges abutting the floor, ceiling and corners for continuous total coverage of the structural wall. After the glue dries, further hardware may be used for mounting to the load bearing wall. Drywall, paneling or other layers may then be connected using conventional hardware to the mounting elements. It can be appreciated that no special skills or special tools are needed for installation. Electrical boxes and other devices may be installed by simply cutting out the portions of a panel and connecting to the wiring or other elements extending through the channels formed by the panels.

The present invention is lightweight, durable, easy to install, long lasting, has improved insulation attributes, is inexpensive, can be used for retrofit applications and minimizes common drawbacks of traditional construction such as mold, water damage and other problems associated with the prior art. The system uses panels that fasten to a structural wall and easy to cut with a conventional knife for individually sizing the panels or cutting additional chases or channels as the panels do not have a metal layer or other material that is difficult to cut. The panels have built in utility chases, drainage channels and inter-panel alignment without using special tracks or plates.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structure throughout the several views.

DETAILED DESCRIPTION OF THE PREFERRED EMBODIMENT

Figure 1:
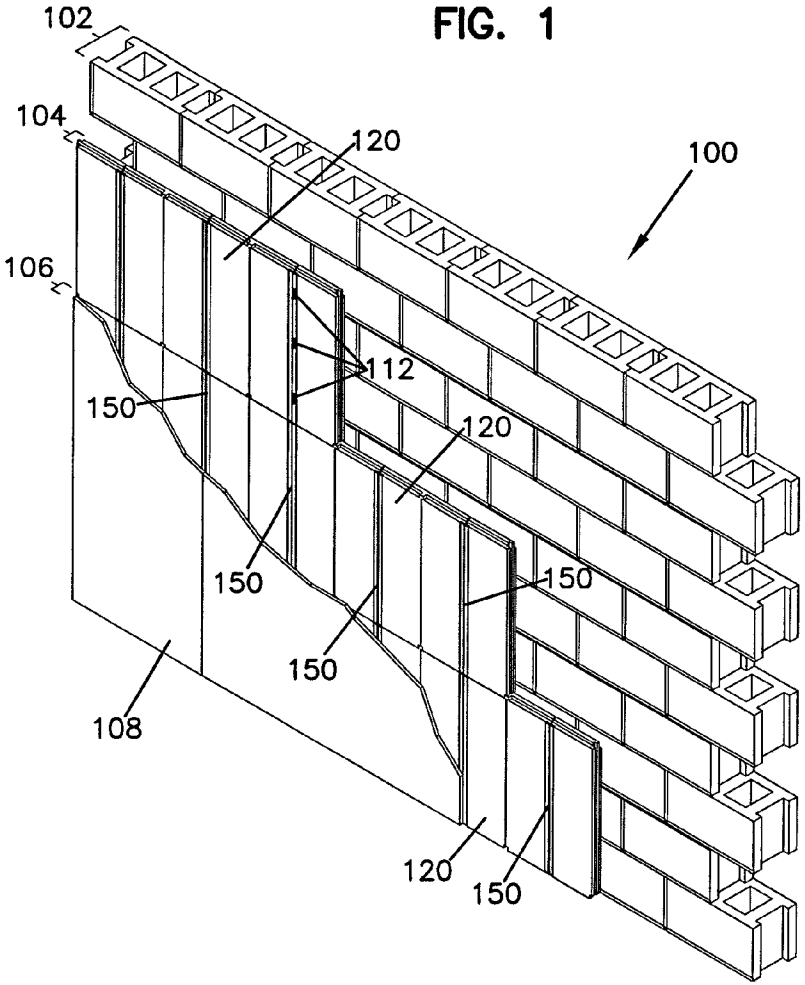
FIG. 1 is a perspective view of an insulation system with portions removed for clarity according to the principles of the present invention.

Referring now to the drawings and in particular to FIG. 1, there is shown a wall system, generally designated 100. The wall system 100 is especially suited for masonry type walls, commonly found in basements and other areas where concrete block or similar construction is utilized. It can be appreciated however that the system 100 of the present invention may be adapted to many other types of applications, such as mounting to conventional frame walls. The wall system 100 may also be applied to other existing substrates including other insulation layers and can provide additional insulation, moisture control and embedded utility chases.

The wall system 100 generally includes a first layer or section, often a load bearing or structural masonry wall 102 formed of concrete block or other similar building materials. An insulation layer 104 formed of interconnected panels, described hereinafter, mounts to the masonry wall layer 102 with glue or fasteners 112. A finishing inner layer, such as paneling, drywall or other finishing type material 106 mounts with fasteners 112, glue or other conventional mounting techniques to the insulating layer 104. A coating 108 such as paint, wallpaper or other final, exposed material that is visible covers the inner layer 106. The technique of the present invention provides for elimination of the conventional stud framing and roll-type insulation and provides improved R-value in a thinner layer, adding floor space and volume to the finished room. In addition, the present invention is less expensive and easier to install than prior conventional building systems and techniques. Although shown mounted to a wall, the present invention may be used for other applications, including ceilings and floors. The insulating layer 104 may also be mounted on an exterior and is suitable for use with a wide variety of building and finishing materials, including stucco.

Figure 2:
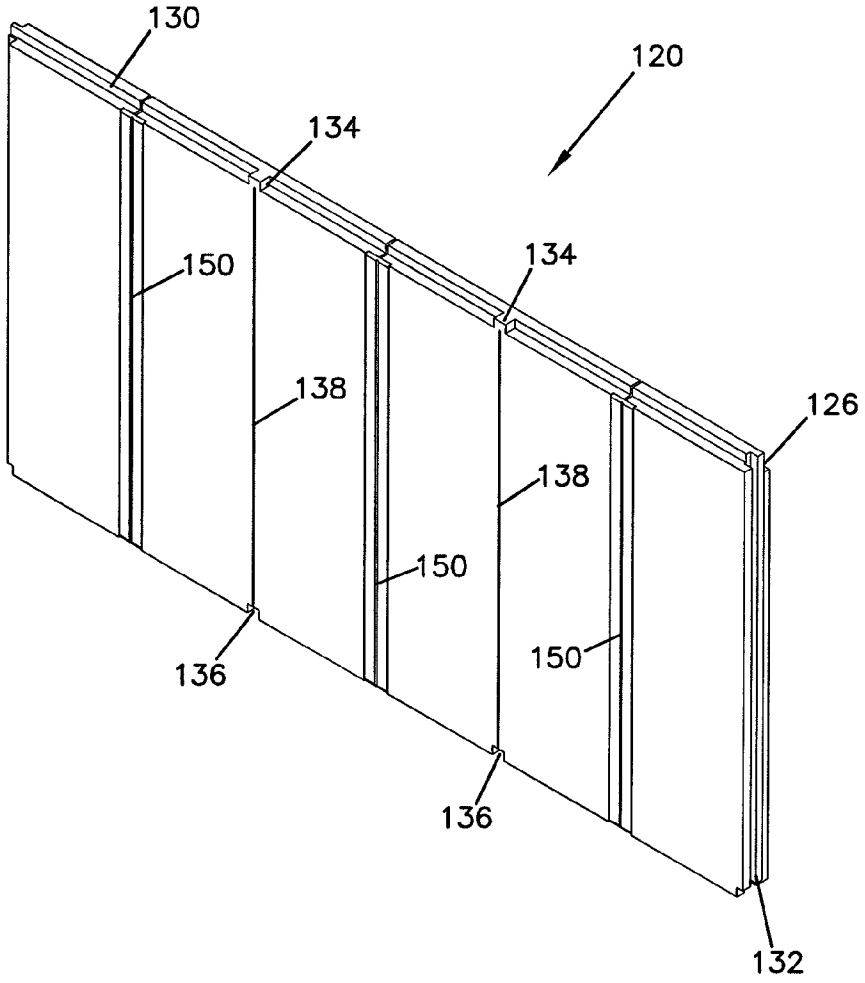
FIG. 2 is a perspective view of a first embodiment of a panel for the insulation system shown in FIG. 1.
Figure 3:
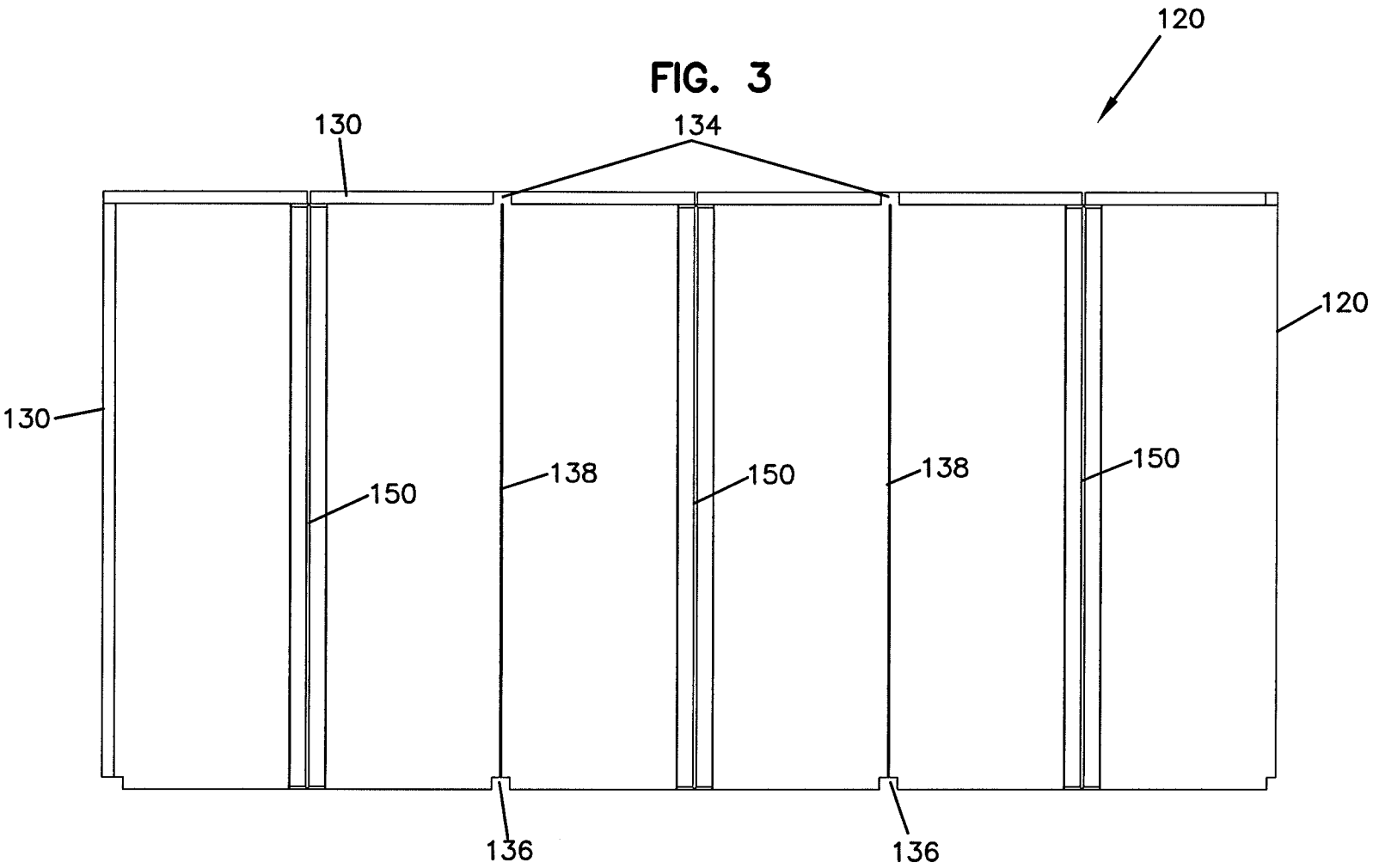
FIG. 3 is a front elevational view of the panel shown in FIG. 2.
Figure 4:
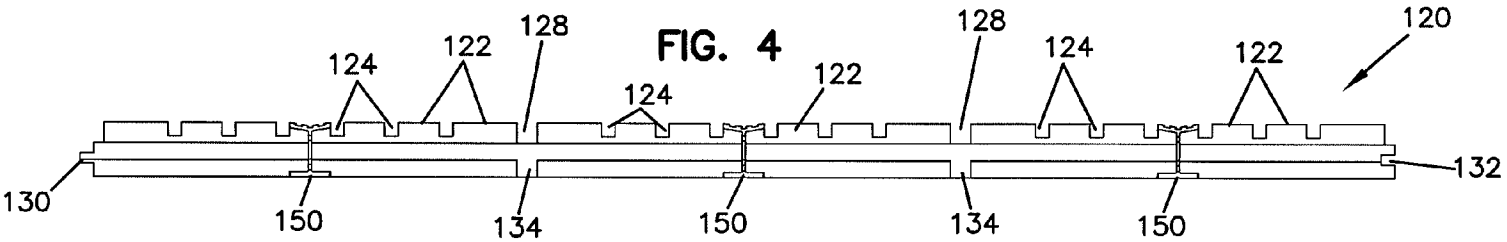
FIG. 4 is a top end view of the panel shown in FIG. 2.

The insulating layer 104 is formed from a number of rectangular insulating panels 120 mounted in an edge-to-edge relationship. The panels are generally rectangular and include tongues 130 and complementary grooves 132, such as shown most clearly in FIGS. 2 and 4, along the edges of the panel 120. The tongues and grooves 130 and 132 provide for alignment and connection along both the horizontal and vertical edges so that the panels 120 may be connected to extend horizontally and vertically in a continuous insulating layer. The panels 120 also include alignment tabs 134 and complementary notches 136 along the top and bottom edges that aid in aligning the panels for final orientation. In one embodiment, the panels 120 are made of a closed cell expanded polystyrene material. Such a material is lightweight, provides excellent insulation performance and is impervious to water. Moreover, such material may include a fire retarder. Although a vapor barrier may also be added to the system, it can be appreciated that with the insulating layer 104 made of a water impervious material and with interlocking edges, the need for a separate vapor barrier used in many applications may be eliminated.

Figure 5:
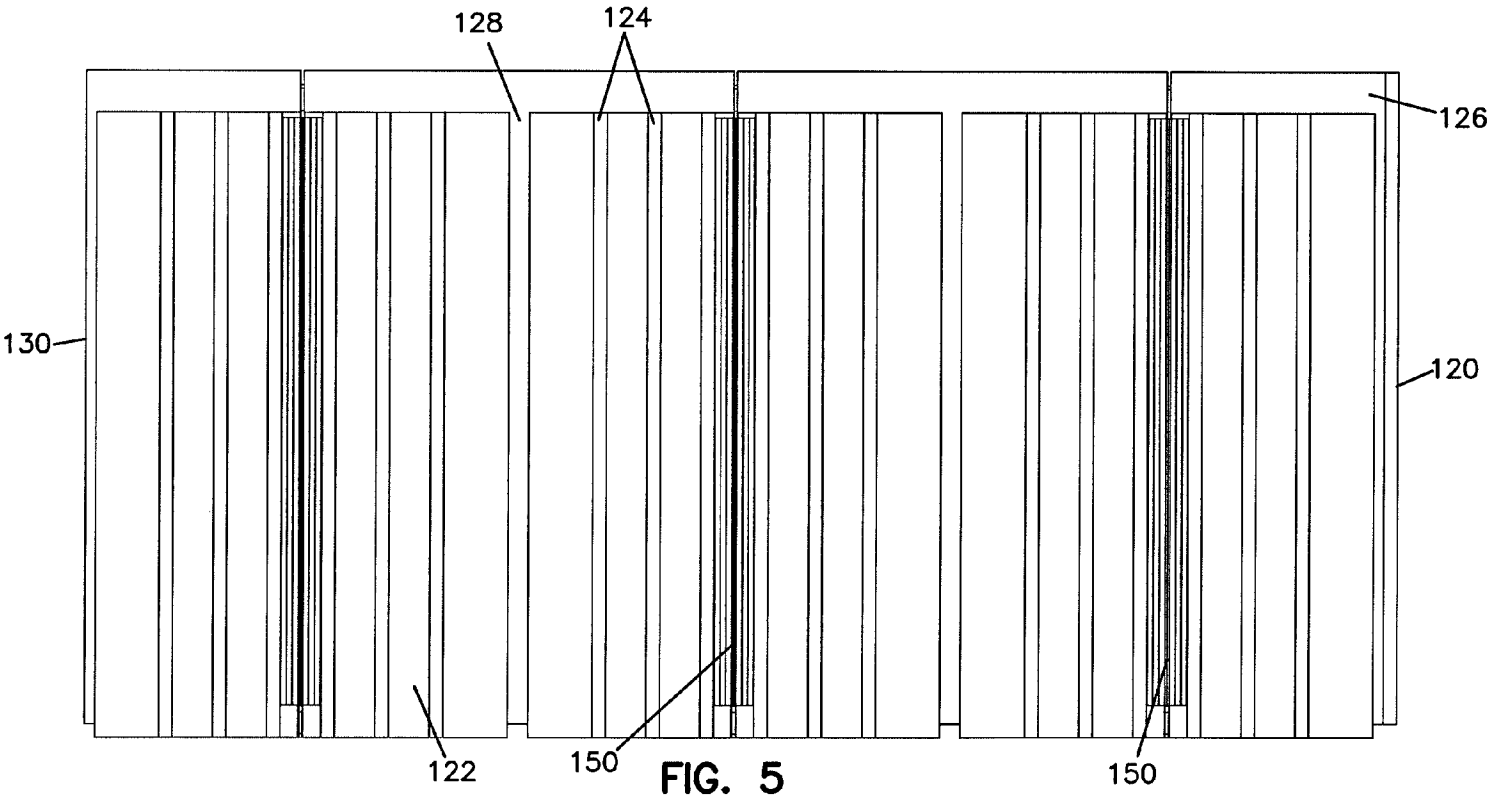
FIG. 5 is a rear elevational view of the panel shown in FIG. 2.
Figure 8:
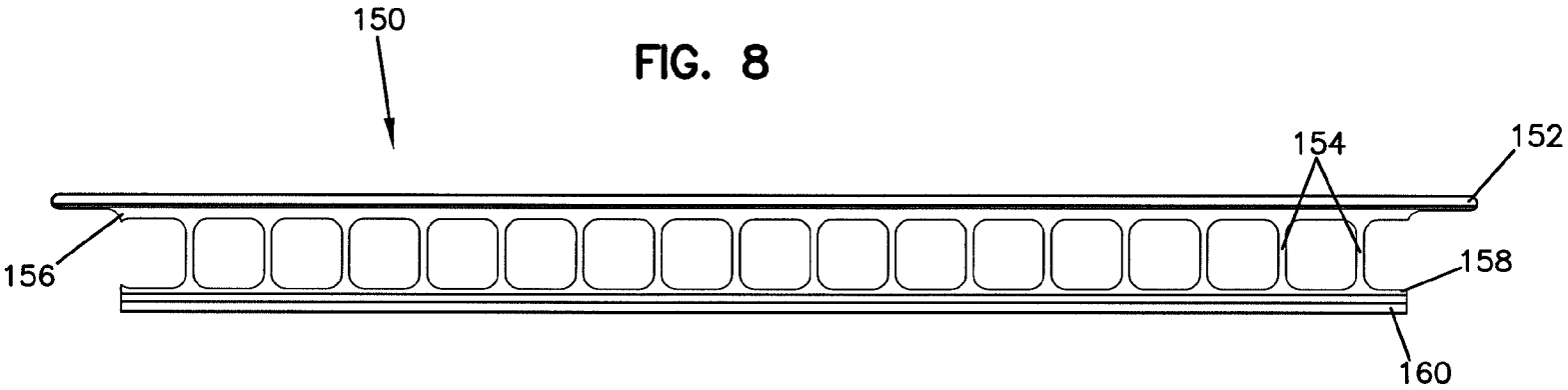
FIG. 8 is a side elevational view of the mounting element shown in FIG. 6.
Figure 7:
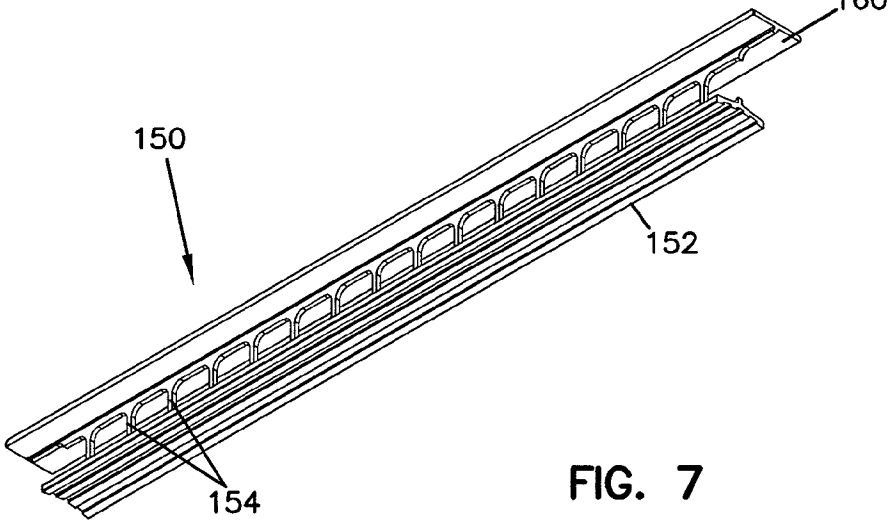
FIG. 7 is an opposite perspective view of the mounting element shown in FIG. 6.
Figure 6:
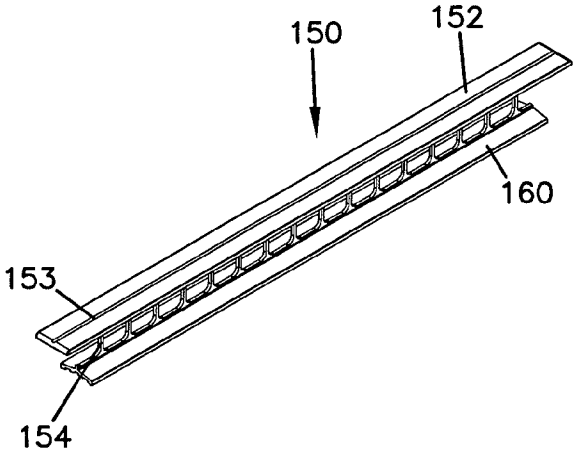
FIG. 6 is a perspective view of a mounting element that is embedded in the panel shown in FIG. 2.
Figure 9:
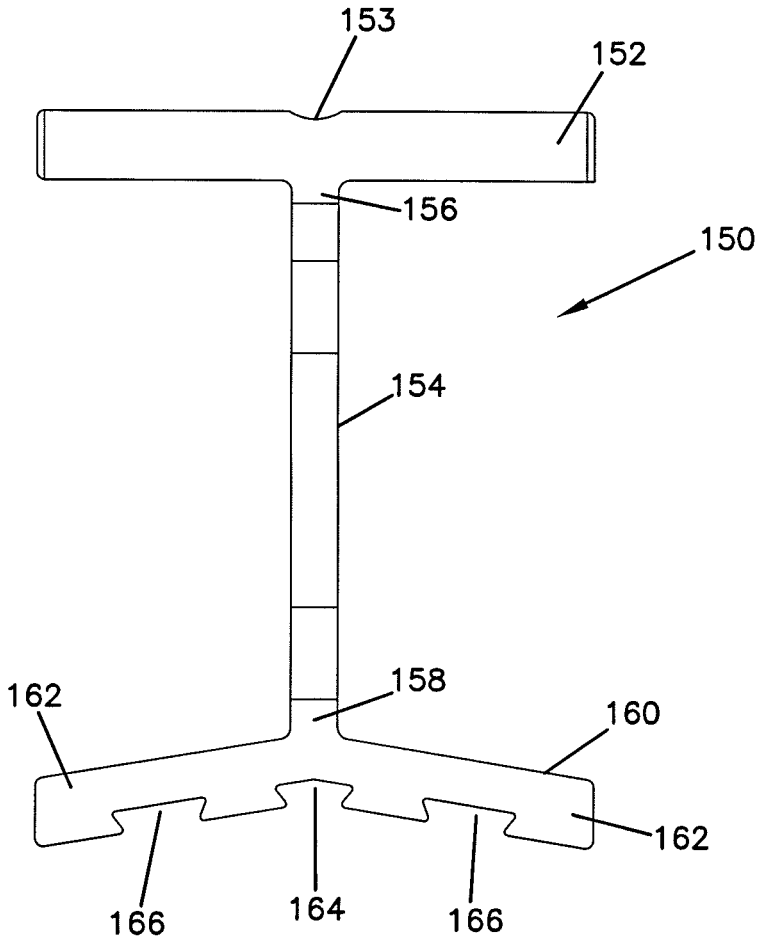
FIG. 9 is an end view of the mounting element shown in FIG. 6.

Referring again to FIGS. 4-5, the panels 120 include a series of parallel ridges 122 formed on one face of the panel. The ridges 122 extend vertically when the panels 120 are mounted and provide first channels 124 that may serve as a utility chase or for running tubing, fiber optics or other elements through the insulating layer without requiring cutting into the panels 120. The channels 124 also allow for water to drain. In addition, some of the channels are deeper, forming utility chases 128. The ridges 122 extend substantially along a large part of the height of the panel 120, but stop short of one edge so that when the panels 120 are attached, horizontally extending channels 126 are formed. The horizontal channels 126 intersect with the vertical channels 124 providing for easy insertion and routing of wiring, tubing and other elements that are typically placed inside a wall. A cutting guide 138 also provides for trimming the panels 120 to a common size and provides a guide for forming a straight edge. It can be appreciated that in one embodiment, the panels are approximately 48 inches wide and 24 inches high (122×61 cm). Although a wide range of thicknesses are envisioned, typical depths for a panel 120 are 2 inches (5 cm), 2⅝ inches and 4 inches. Such a size provides for standard alignment and easily transporting the panels 120 down narrow staircases such as often lead to a basement.

The panels 120 also include mounting elements 150 that serve as studs at least partially embedded in the panels. In one embodiment, each panel 120 includes three embedded mounting elements 150. The mounting elements 150 extend vertically when the panels 120 are installed. The mounting elements 150 are placed at 16 inch (41 cm) centers as is typical with wood stud construction. The mounting elements 150 extend to a first face of the panels 120 and provide a surface for gluing as well as receiving conventional fasteners such as bolts, screws and/or nails. The mounting elements 150 are lightweight, but provide rigidity and strength to the panels 120.

As shown in FIGS. 6-9, each mounting element 150 is a substantially elongate, molded plastic element with a generally "H" shaped cross-sectional profile. The mounting element 150 includes a first mounting portion 152, a second opposed mounting portion 160, and a series of central ribs 154 connecting the first portion 152 and the second portion 160. The first portion 152 extends laterally outward from the ribs 154 at a generally right angle. A first face of the first portion 152 includes a channel 153 or channels transverse to the longitudinal direction. The channels 153 provide a recess for the head of a mechanical fastener may be recessed so as not to protrude upward above the face of the panel 120. The channels 153 may also be used as a location for adhesive. The ribs 154 include a first ridge portion 156 connecting to the first portion 152 and a second ridge portion 158 connecting to the second portion 160. The second mounting portion 160 includes leg sections 162 extending from either side of the center ribs 154 and extending slightly outward along the direction of the ribs. The leg sections 162 each include an outer channel 166. The second portion also includes a center channel 164 substantially aligned with the ribs 154. The channels 164 and 166 receive adhesive used to bond to concrete and other mounting surfaces.

The mounting elements 150 are spaced apart generally in the same spacing as wood studs or other common spacing such as 8, 12, 16 or 24 inch intervals and provide a lightweight yet durable surface for receiving mounting hardware, as discussed above. The mounting elements 150 are also lightweight and molded and impervious to water for durable and inexpensive construction. It can be appreciated that the system of the present invention reduces the likelihood for water damage, mold and other problems that conventional building techniques are prone to, especially when set in a damp environment, such as a basement. It can further be appreciated that the present invention provides for easy trimming and cutting with a hand saw or simple knife. The materials used are not irritating to skin or eyes and do not require special gloves for handling as is needed for fiberglass systems. The materials are lightweight and of a size that is easier to handle than typical long wood studs and 4 feet by 8 feet foam insulation boards. Drywall seams do not need to be aligned with studs as in conventional techniques since the panels 120 form a continuous backing for drywall and does not have open cavities. Installation is much quicker and does not require special skills or tools as the panels can be cut to the required size with conventional knives or cutting blades. Moreover, the present invention can be retrofit to existing wall systems and provide improved insulating characteristics.

Figure 60:
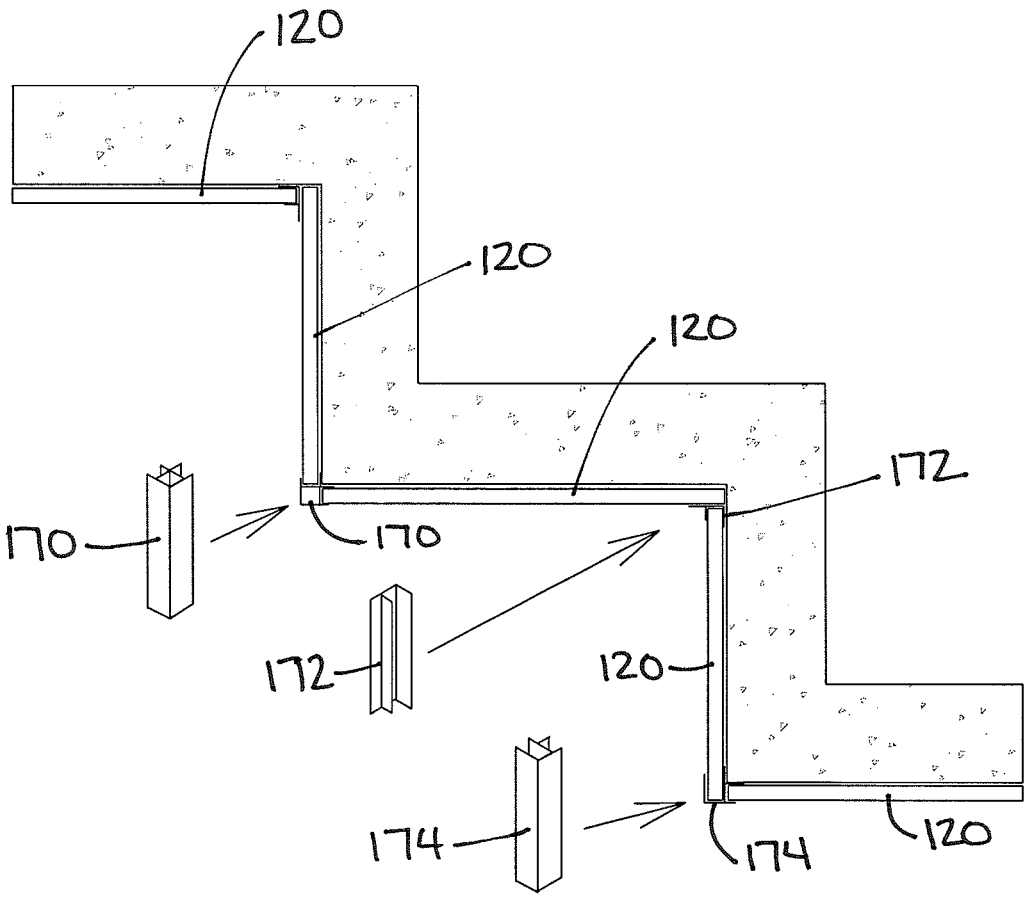
FIG. 60 is a top plan view of a series of panels joined together and forming corners with details of corner moldings.

The wall system 100 of the present invention is also easy to install. Little preparation is needed but drain tile, if necessary, is installed before the system is in place. The panels 120 can be installed using only conventional mechanical connectors, adhesive or a combination of mechanical mounting hardware and adhesive. A bead of construction adhesive is placed in the channels 164 and 166 on all three of the studs 150 on each panel 120. Installation generally starts in a lower corner of the wall with the panel 120 simply pressed onto the inner masonry wall 102. The panel 120 is then secured with a power fastening device or other conventional mounting hardware. Installation continues with the panels 120 being aligned and vertically extending tongues 130 inserting into corresponding grooves 132 until a bottom row of panels 120 extends across the wall. The panels 120 of the next row are generally offset from the previous row and placed starting along one edge and working along the row in a similar manner to create a self-flashed drainage plane. The mounting elements 150 are aligned by the alignment tabs 134 inserting into the corresponding notches 136. Construction continues along horizontal rows until the entire wall is covered. The corners are accommodated by cutting off the tongues and/or grooves and butting the panels 120 together. Alternatively as shown in FIG. 60, corner moldings may be utilized. Such extruded elements include a first corner molding 170, a second "F" style corner molding 172 and a third corner molding 174. Such moldings easily attach to an edge of the panels 120 extending perpendicular to one another and provide a finished right angle. Plywood, paneling or other layers may be attached to the panels 120 in the field. The mounting elements 150 supported by the foam provide for transferring load thought the panels 120 to the opposite face.

Spaces for receiving electrical boxes can be cut into the panels 120 using a standard drywall keyhole saw. Wiring and other elements can be run through the wall 100 by leading the wiring through the channels 124, 126 and 128. When the panels 120 have been installed, the glue is generally allowed to dry for a period of time such as 24 hours. Once the glue sets, the drywall can be applied by using standard drywall screws attaching to the mounting elements 150. The wall 100 is finished in the same manner as conventional walls with mud and tape used with the drywall and an inner layer such as paint or wallpaper applied over the drywall. In some applications, paneling or other materials may be used rather than drywall. The method is typically faster and easier with less skill and fewer tools required than conventional construction techniques.

Figure 10:
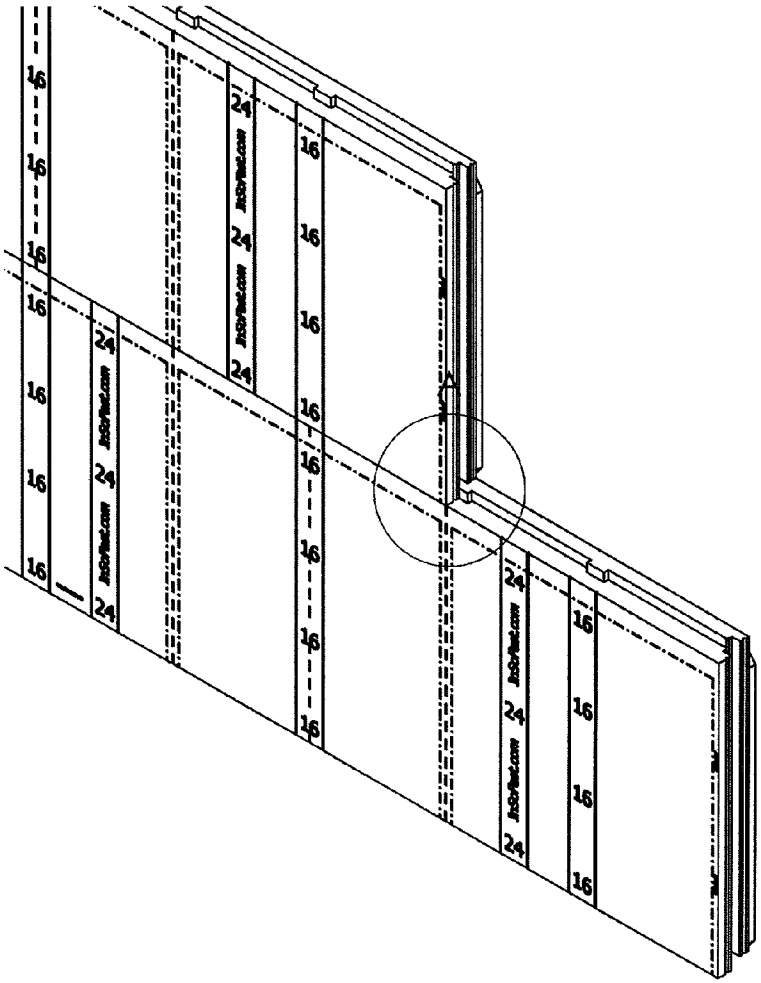
FIG. 10 is a first perspective view of a portion of an insulation system utilizing a second embodiment of panels.
Figure 11:
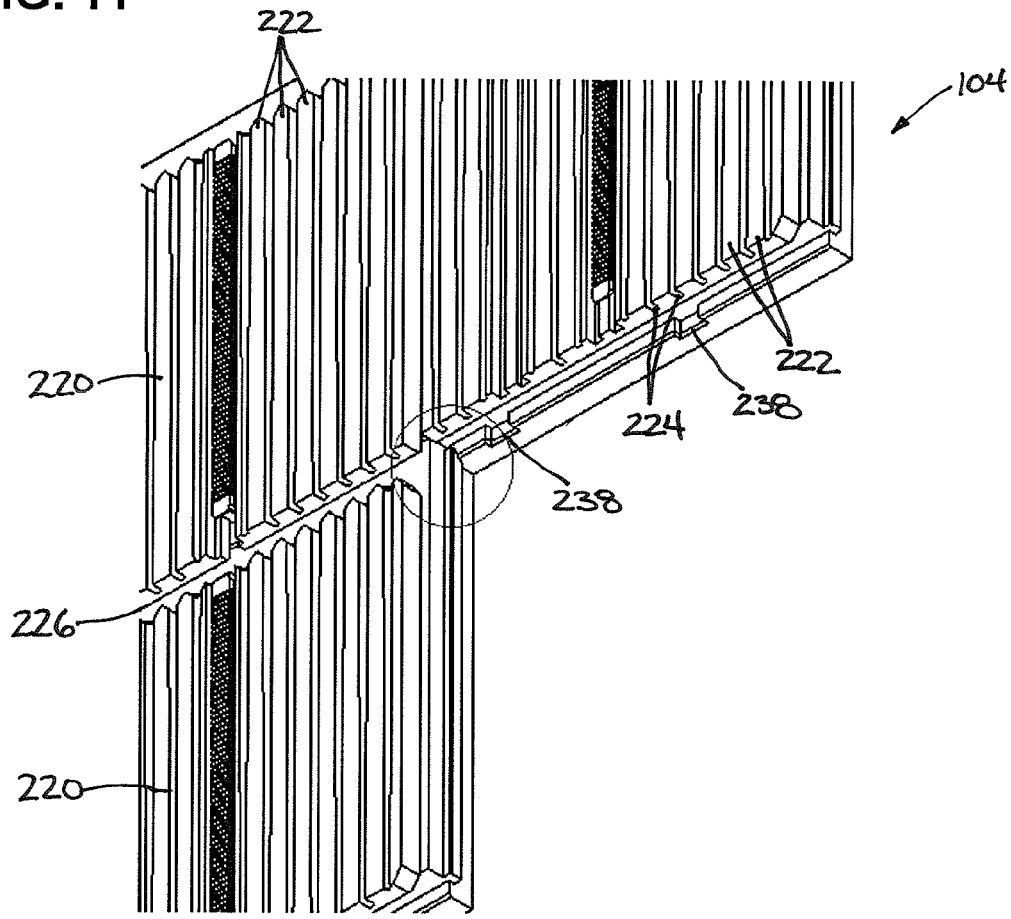
FIG. 11 is a second perspective view of a portion of the insulation system shown in FIG. 10.
Figure 12:
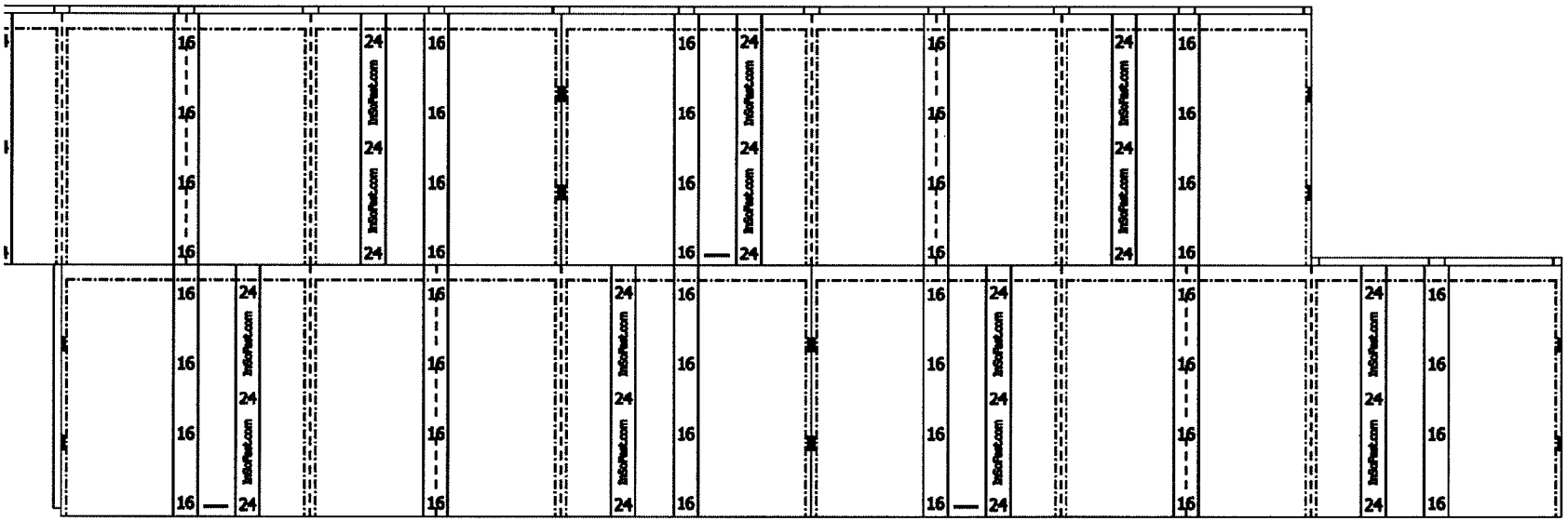
FIG. 12 is a front elevational view of a series of panels fitted together for the insulation system shown in FIG. 10.
Figure 13:
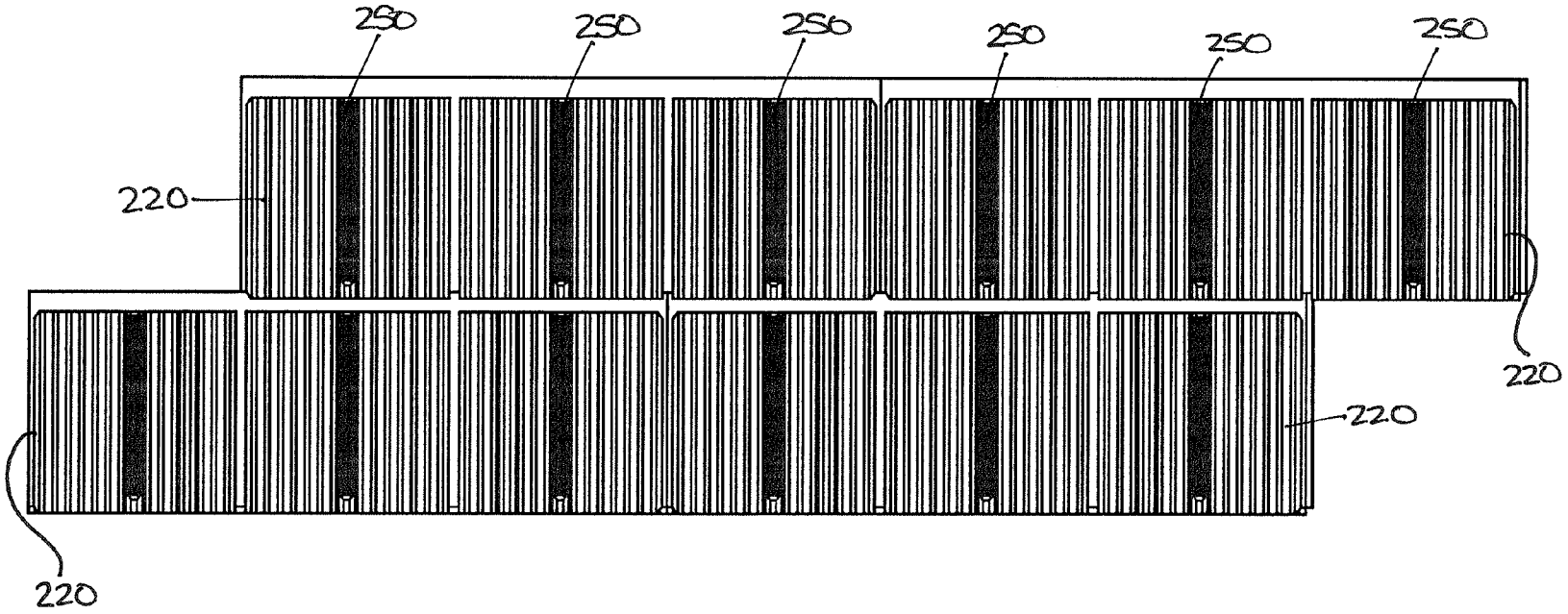
FIG. 13 is a rear elevational view of the panels fitted together for the insulation system shown in FIG. 12.
Figure 14:
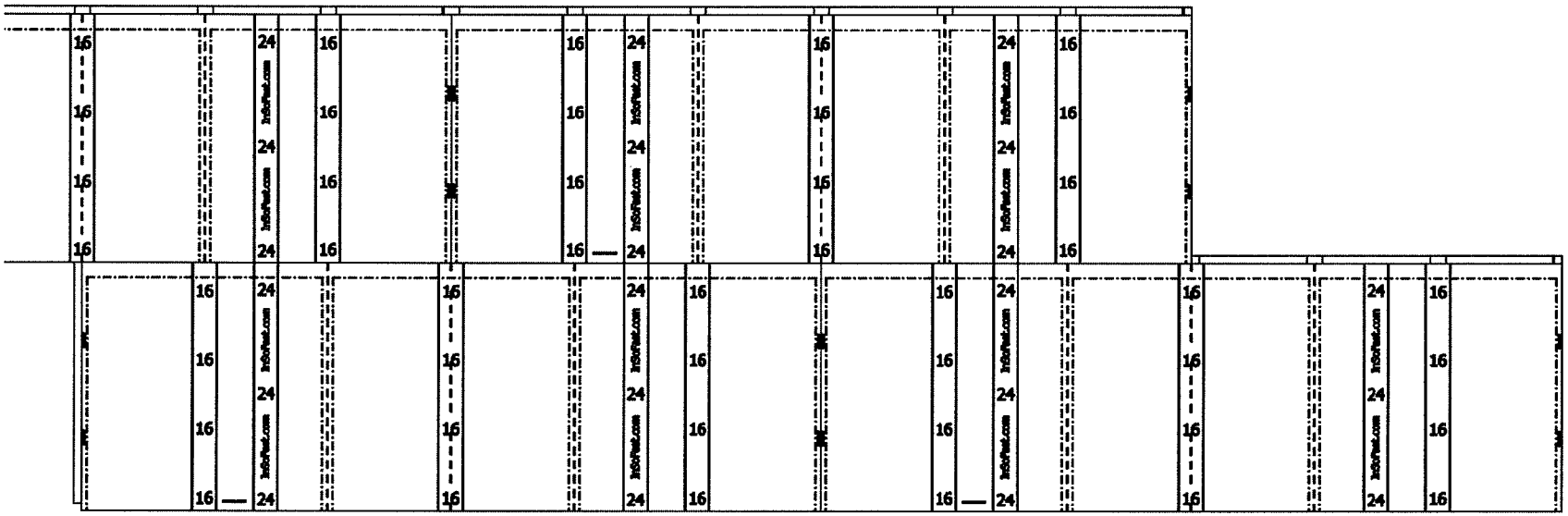
FIG. 14 is a front elevational view of a series of panels fitted together for the insulation system shown in FIG. 10 with a second spacing.
Figure 15:
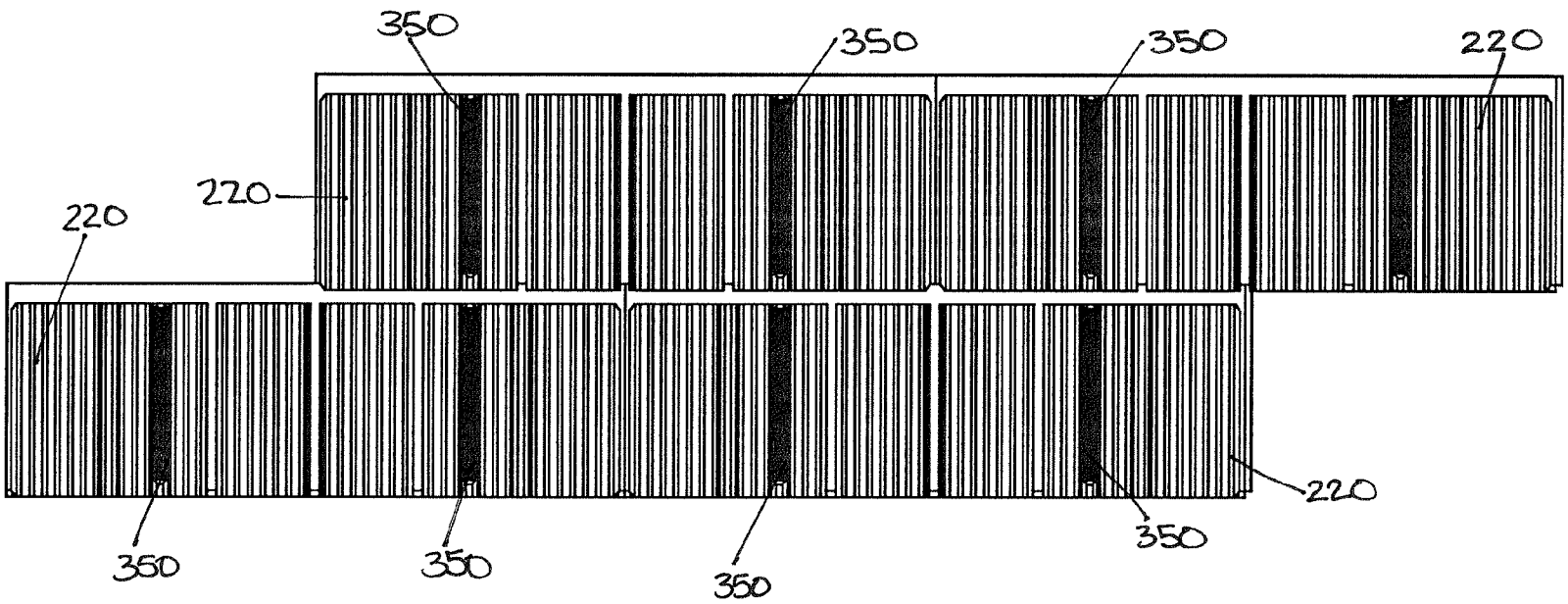
FIG. 15 is a rear elevational view of the panels fitted together for the insulation system shown in FIG. 14.
Figure 16:
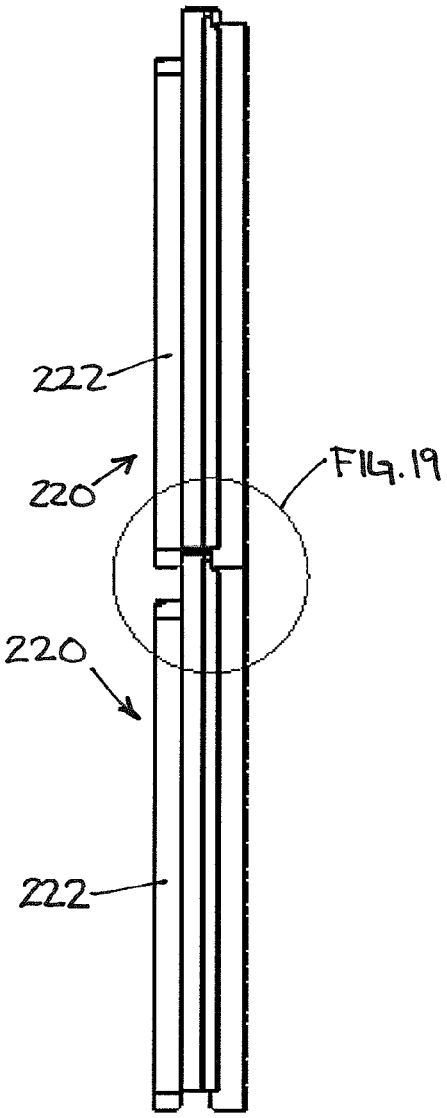
FIG. 16 is a side elevational view of two panels fitted together for the system shown in FIG. 10.

Referring now to FIGS. 10 and 11, there is shown a portion of the insulation layer 104 with a second embodiment of panels, designated 220. The panels 220 can be conveniently configured for arrangement at typical spacing such as 16 inches, 24 inches or other intervals as may be prescribed by industry standards. The panels 220 are shown spaced at 16 inches in FIGS. 12 and 13 and at 24 inches in FIGS. 14 and 15. It can be appreciated that the exterior of the panels 220 includes indicia 280, 282 and 284 that aid in alignment. Indicia 280 indicate alignment of panels 220 being offset with alignment ensuring that the mounting elements are easily accessed and can be found and aligned. In addition, indicia 282 show positions of mounting elements mounted on 24 inch centers. Indicia 284 designate cut lines aligning the panels 220 in an offset manner from one row to the next as well as marking the chase locations.

Figure 31:
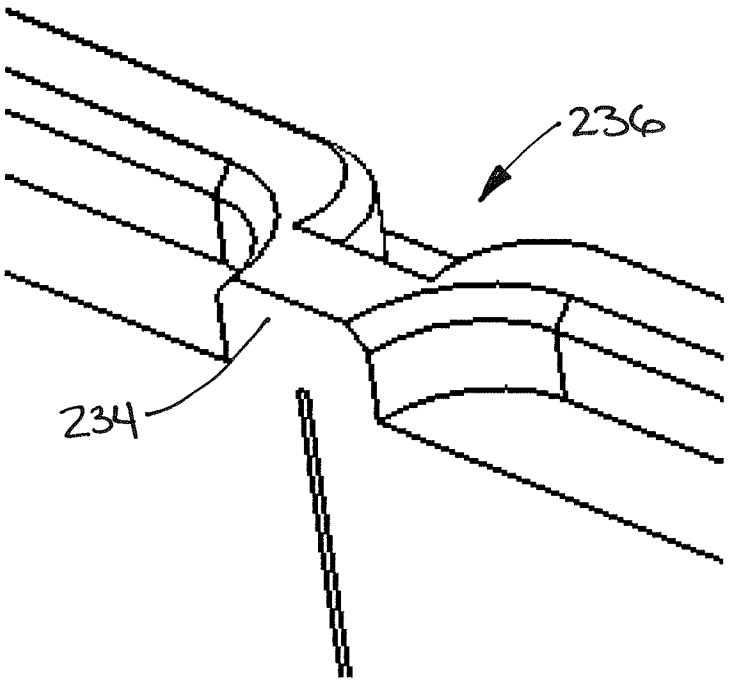
FIG. 31 is a front detail perspective view of a top alignment notch for panels in the system shown in FIG. 2.
Figure 32:
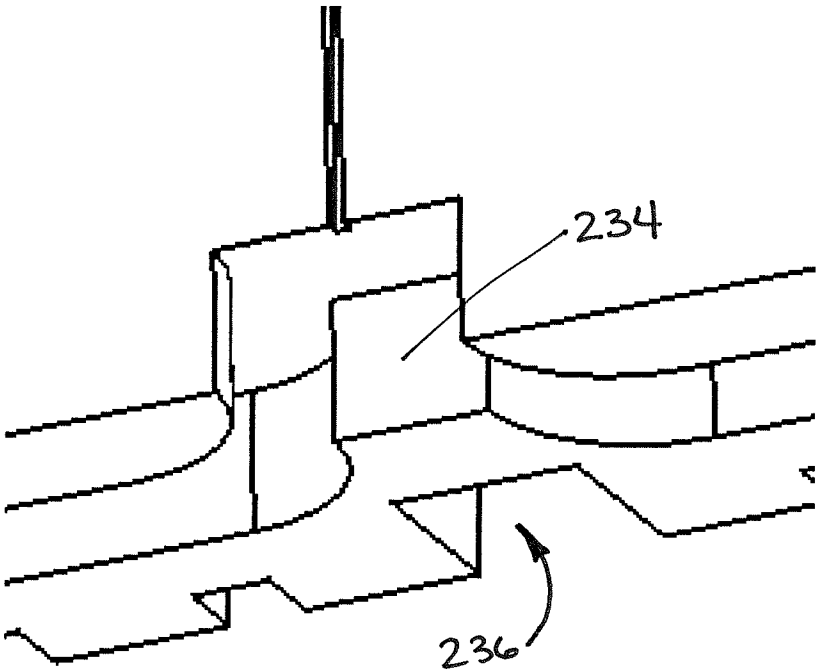
FIG. 32 is a rear detail perspective view of a bottom alignment notch for panels in the system shown in FIG. 2.
Figure 33:
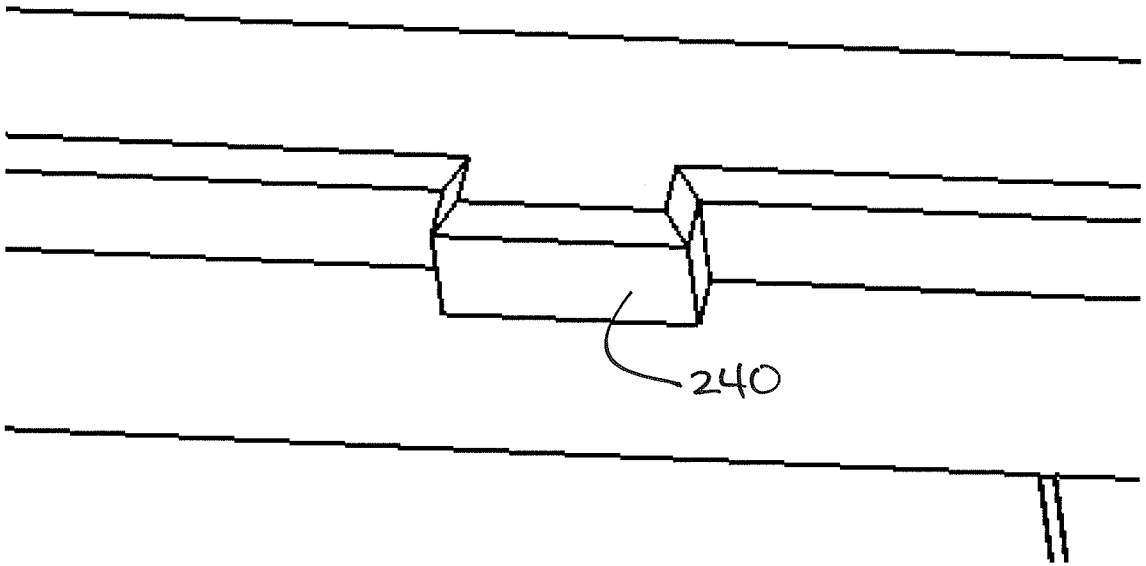
FIG. 33 is a front detail perspective view of a top alignment notch for panels in the system shown in FIG. 14.
Figure 34:
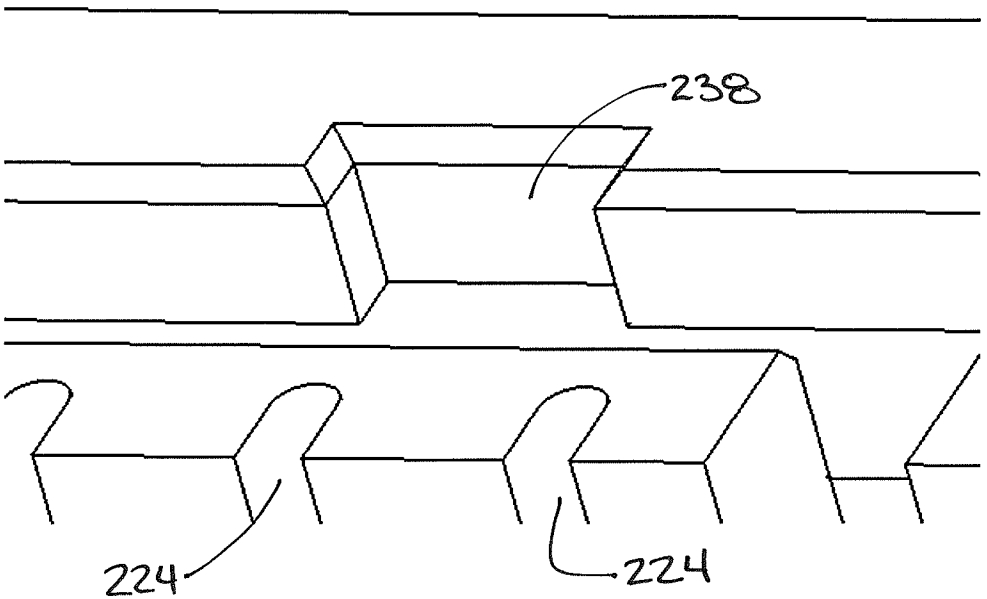
FIG. 34 is a rear detail perspective view of a bottom alignment notch for panels in the system shown in FIG. 14.
Figure 35:
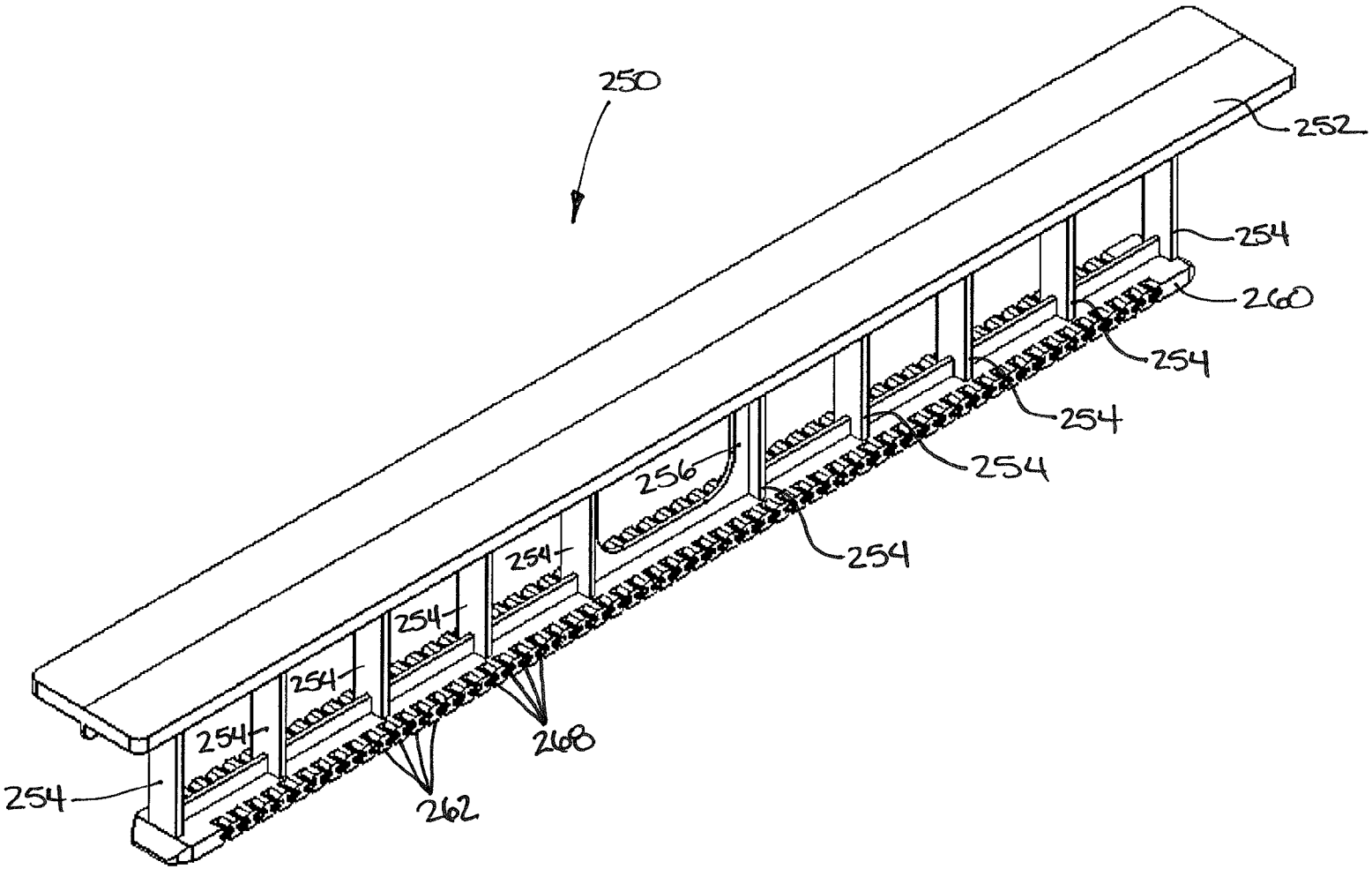
FIG. 35 is a perspective view for a mounting stud embedded in the panels for the system shown in FIG. 12.
Figure 36:
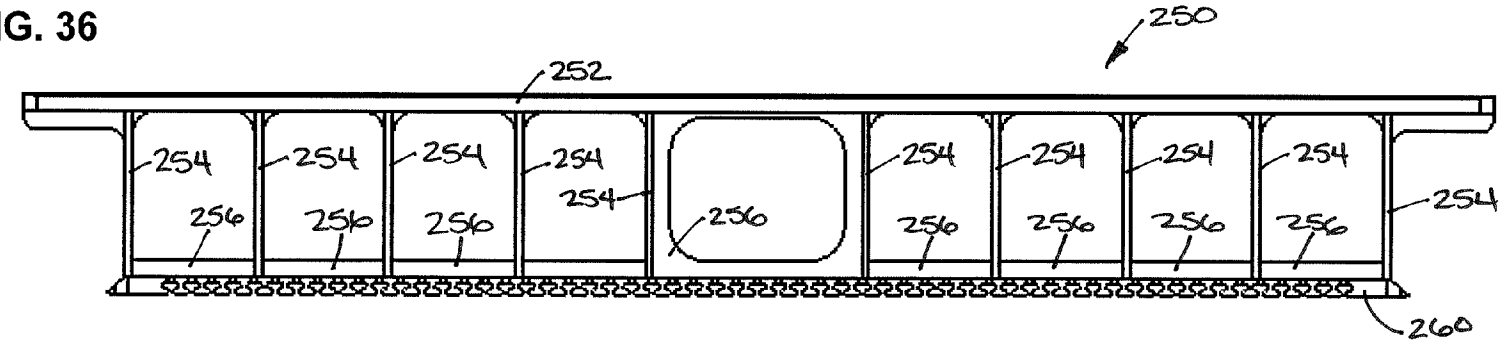
FIG. 36 is a front elevational view of the mounting stud shown in FIG. 35.
Figure 37:
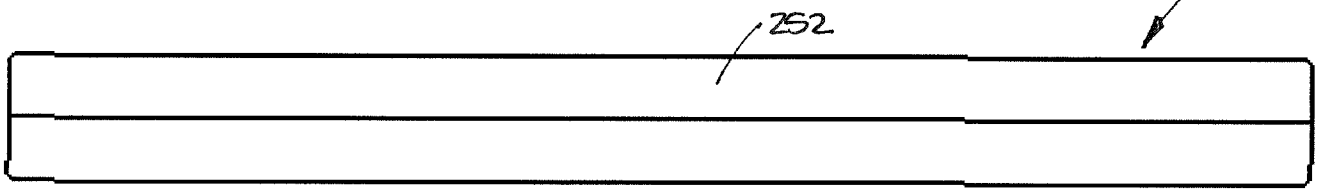
FIG. 37 is a top plan view of the mounting stud shown in FIG. 35.
Figure 38:
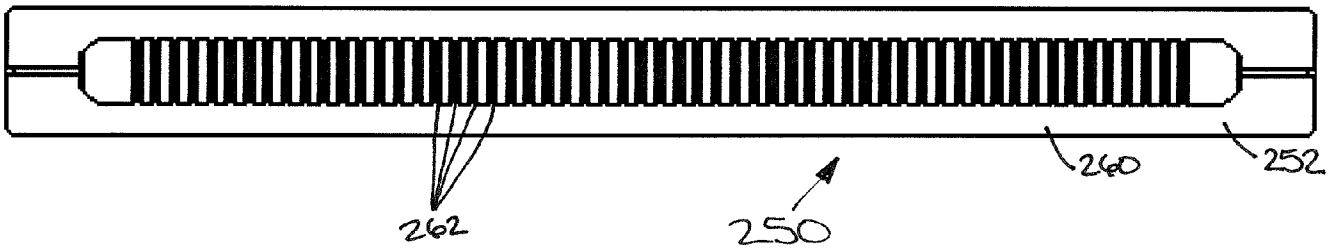
FIG. 38 is a bottom plan view of the mounting stud shown in FIG. 35.
Figure 42:
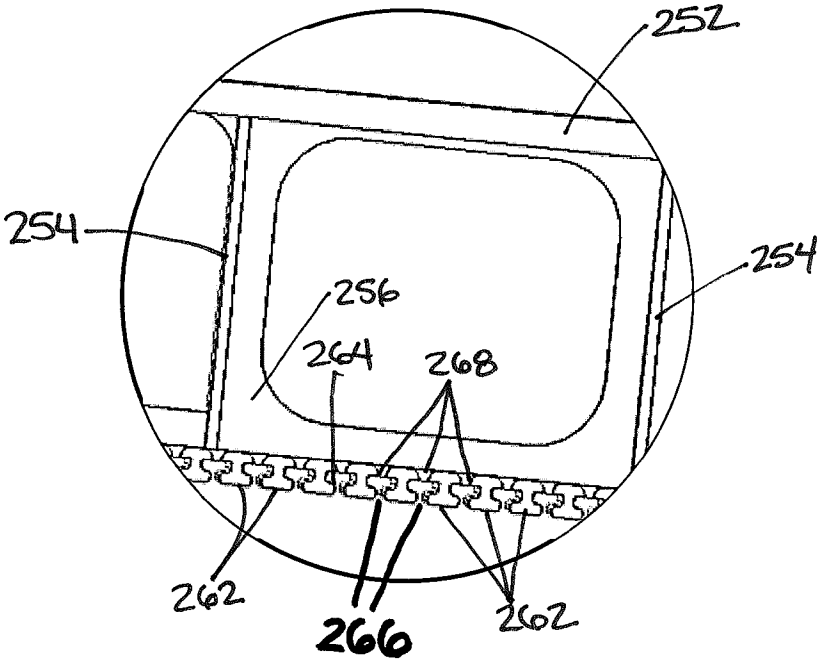
FIG. 42 is a detail view of a portion of the mounting stud shown in FIG. 35.
Figure 39:
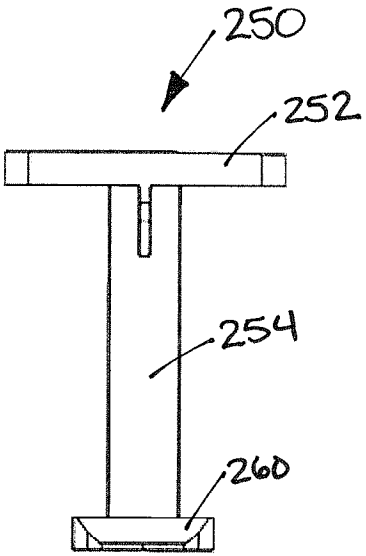
FIG. 39 is an end elevational view of the mounting stud shown in FIG. 35.
Figure 40:
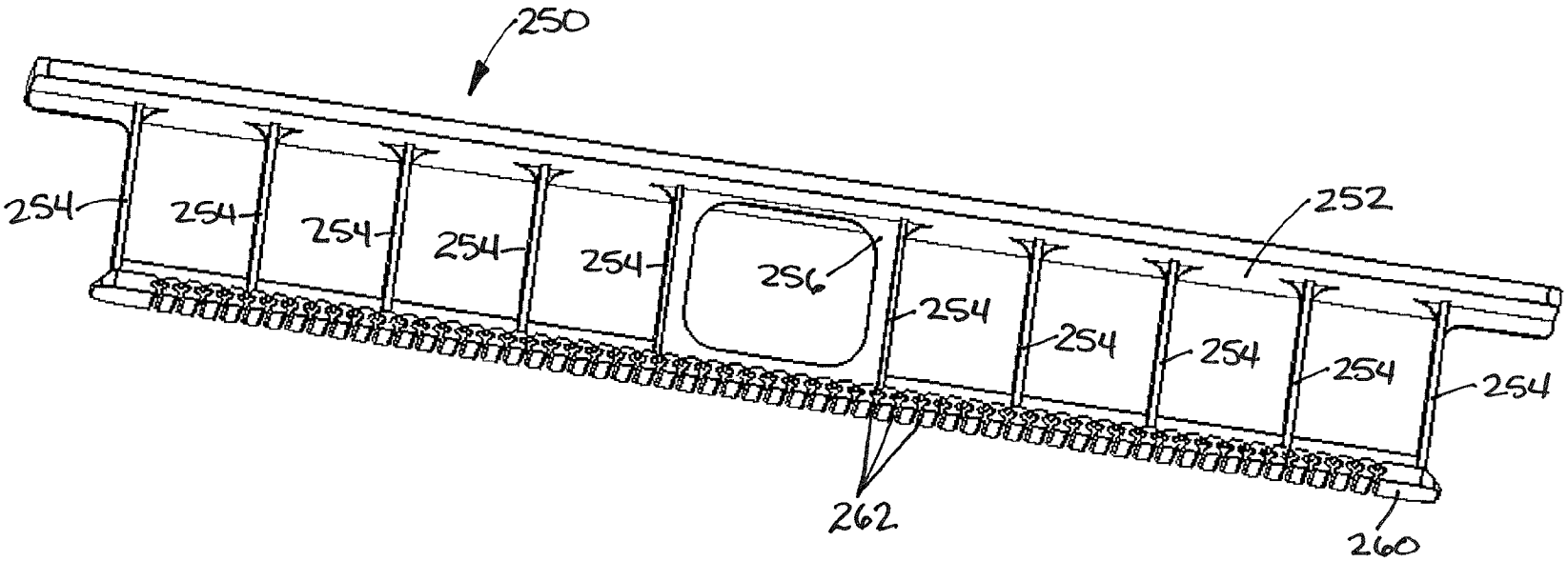
FIG. 40 is a bottom perspective view of the mounting stud shown in FIG. 35.
Figure 41:
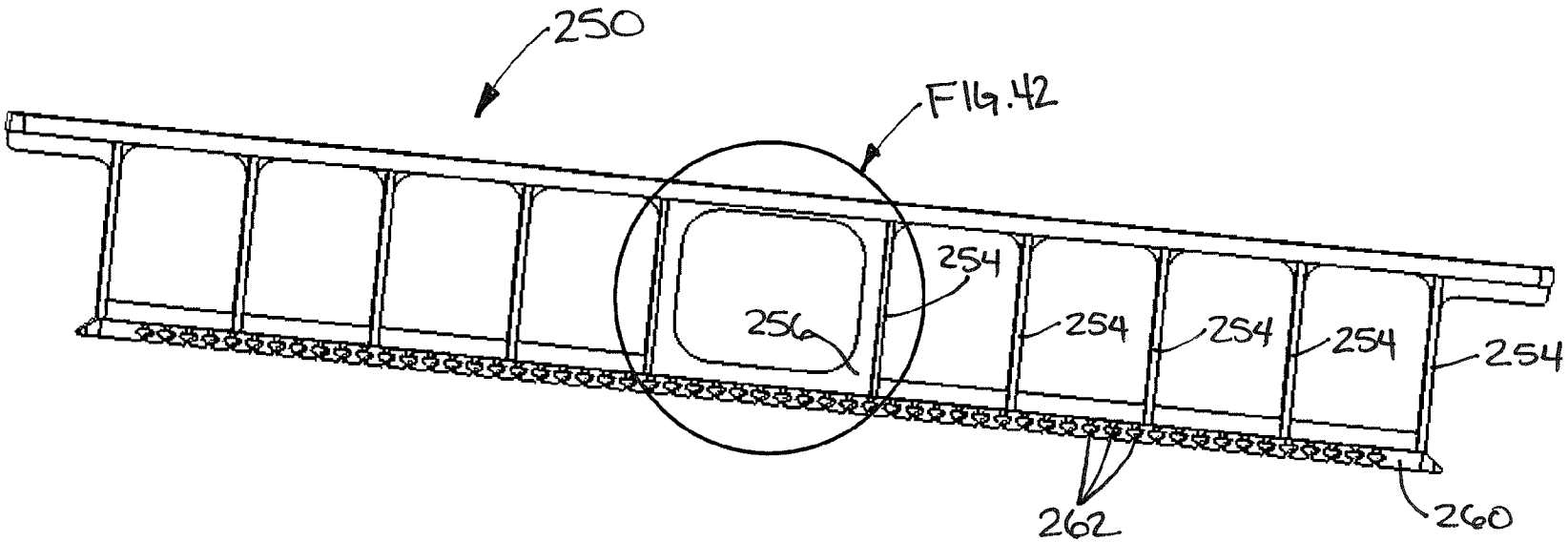
FIG. 41 is a side bottom perspective view of the mounting stud shown in FIG. 35.
Figure 43:
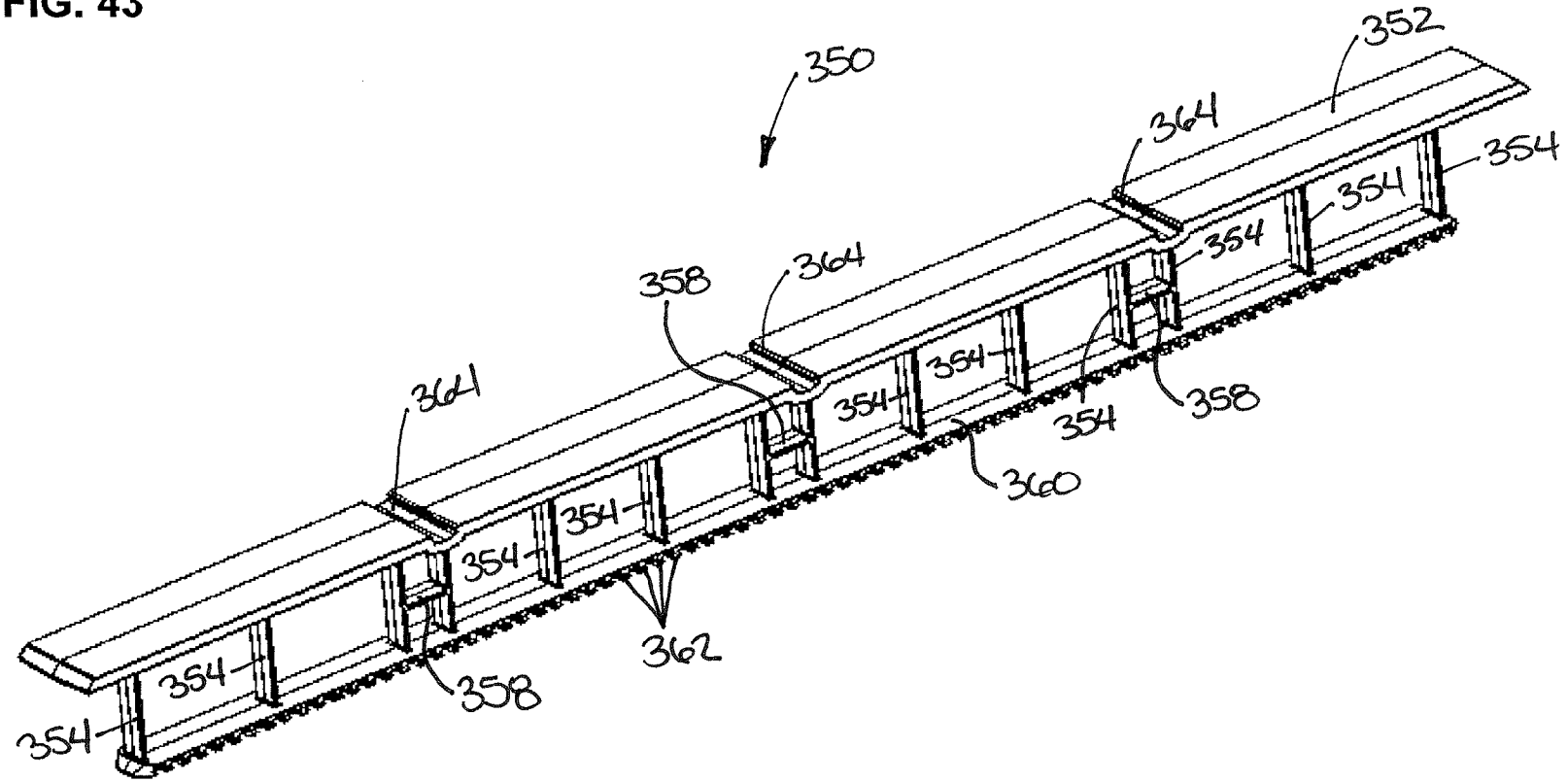
FIG. 43 is a perspective view for a mounting stud embedded in the panels for the system shown in FIG. 2.
Figure 44:
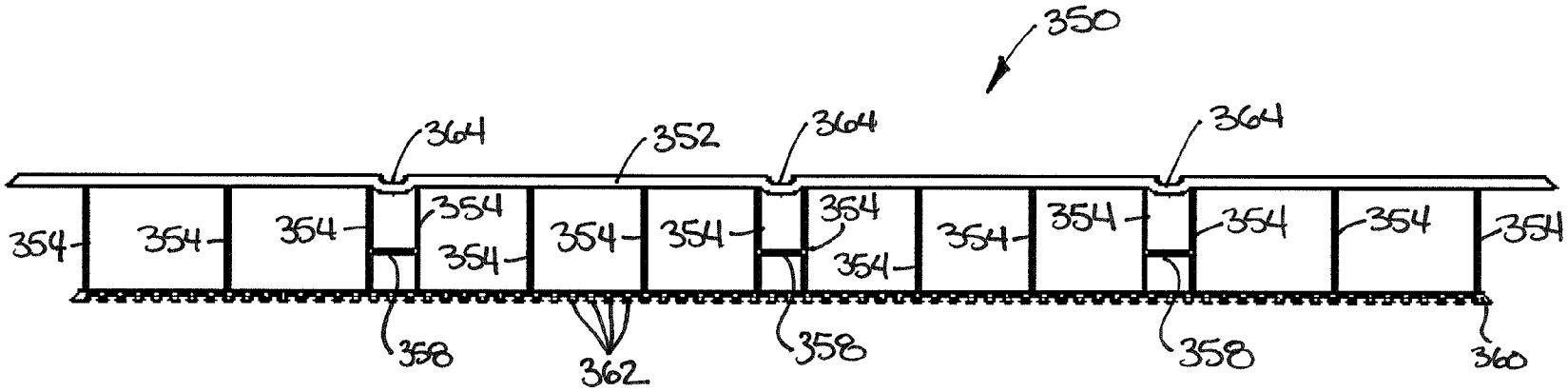
FIG. 44 is a front elevational view of the mounting stud shown in FIG. 43.
Figure 45:
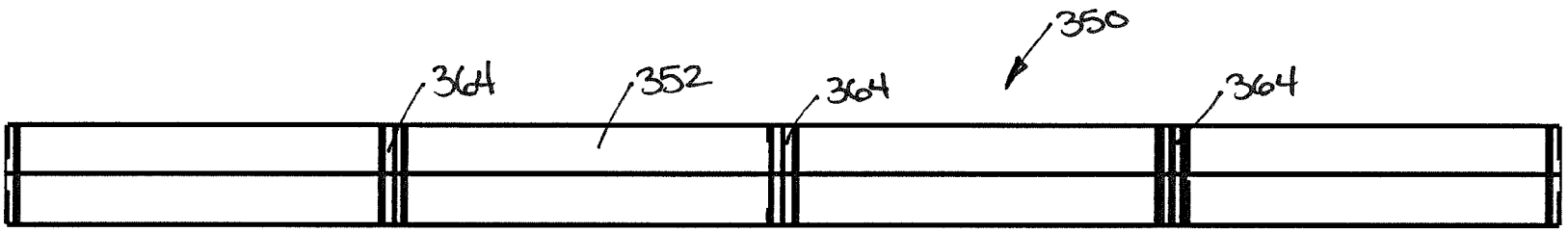
FIG. 45 is a top plan view of the mounting stud shown in FIG. 43.
Figure 46:
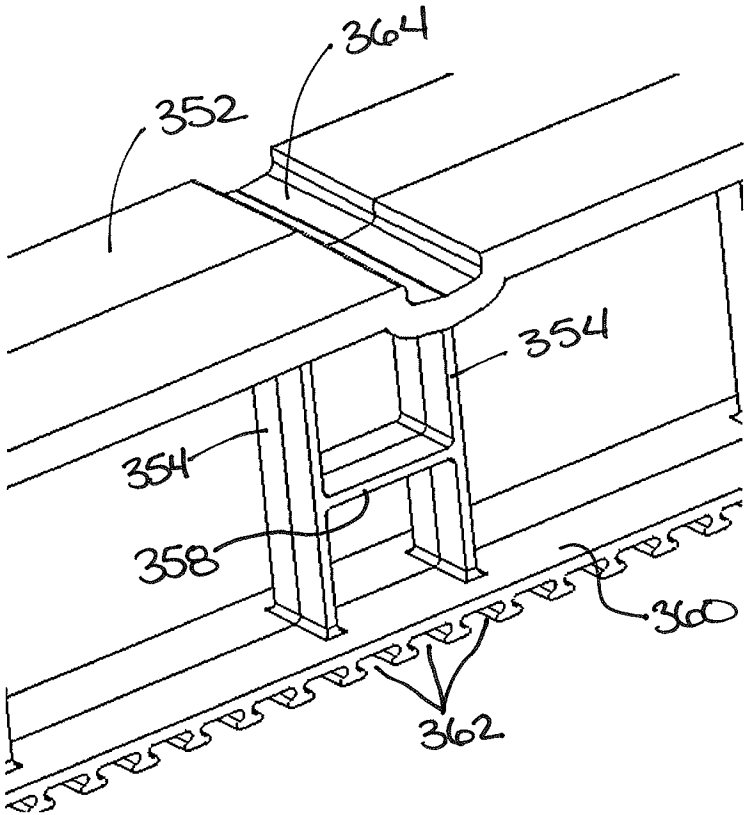
FIG. 46 is a perspective detail view of the mounting stud shown in FIG. 43.

Referring to FIGS. 21-27, the panel 220 has the indicia 280, 282 and 284 on a first face and ribs 222 forming channels 224 and races 228 on the second face of the panel 220. As also shown in FIG. 11, when the panels 220 are assembled together, horizontal channels 226 are formed on the second face of the insulation layer 104. The channels 224 provide for directing moisture as well as routing utility lines or cables, depending upon the size, across the face of the panels 220. In addition, deeper wiring chases 228 are formed intermittently and extending vertically along the second face of the panels 220. It can also be appreciated that as the panels 220 are molded expanded foam panels, further channels may simply be cut into the panels 220 when needed. It has been found that a hot knife works exceptionally well to cut chases into the panels 220 and the hot knife can also be used for easy cutting through the mounting studs. To align the panels 220 together, two of the edges include tongues 230 while the other edges include complementary grooves 232. Alignment is further accomplished with tabs 240 and complementary notches 238, as shown in FIGS. 33 and 34. In addition, as shown in FIGS. 31 and 32, a second embodiment of notches 236 may be configured to accept complementary tabs 234.

Figure 17:
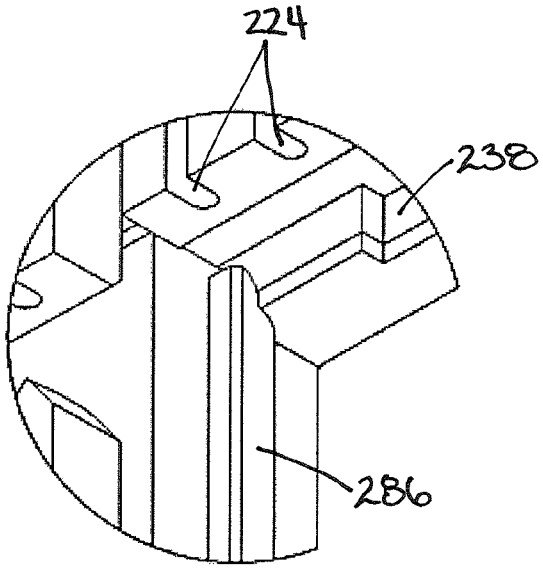
FIG. 17 is a perspective detail view of an inner corner of a tongue and groove connection for the system shown in FIG. 10.
Figure 19:
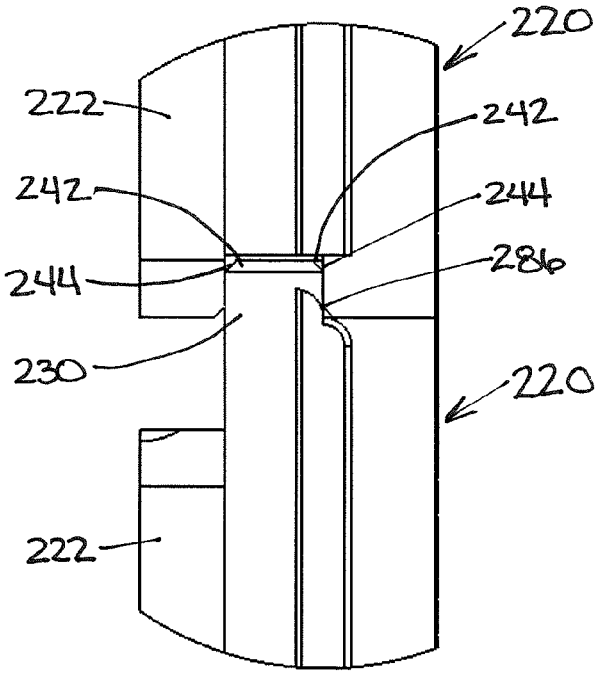
FIG. 19 is a side detail view of a top and bottom tongue and groove connection for the system shown in FIG. 10.
Figure 18:
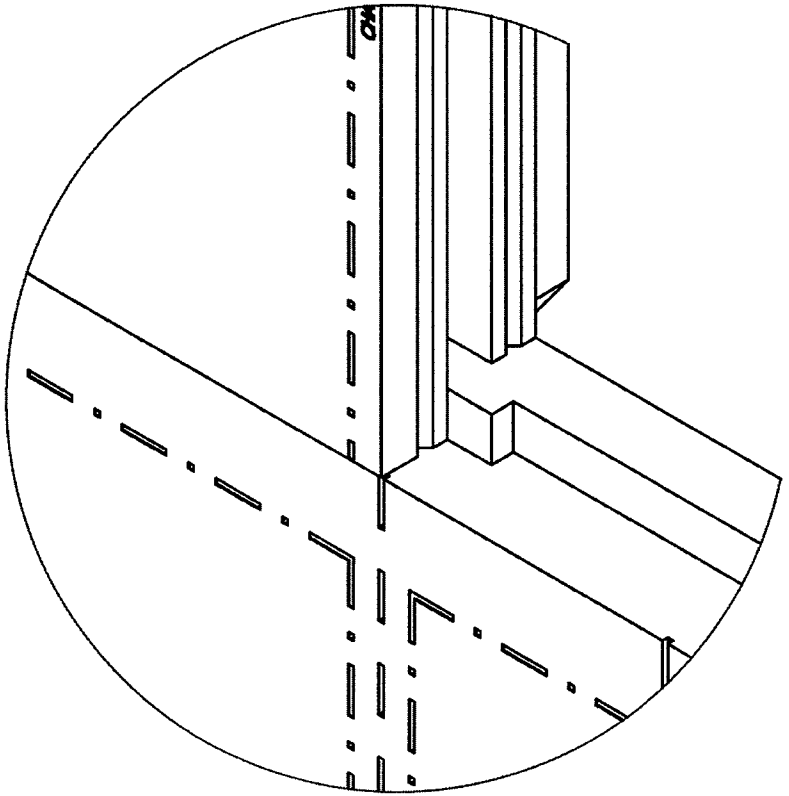
FIG. 18 is a perspective detail view of an outer corner of a tongue and groove connection for the system shown in FIG. 10.
Figure 20:
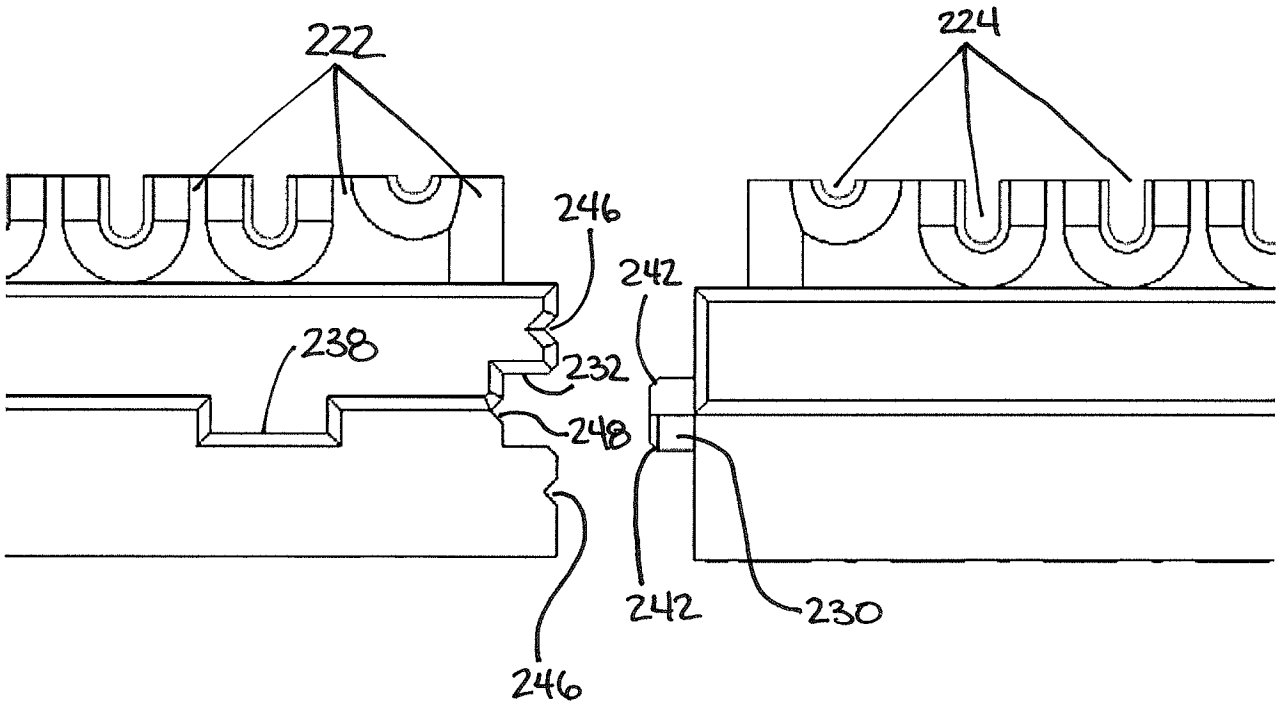
FIG. 20 is a side detail view of the a disconnected tongue and groove.
Figure 21:
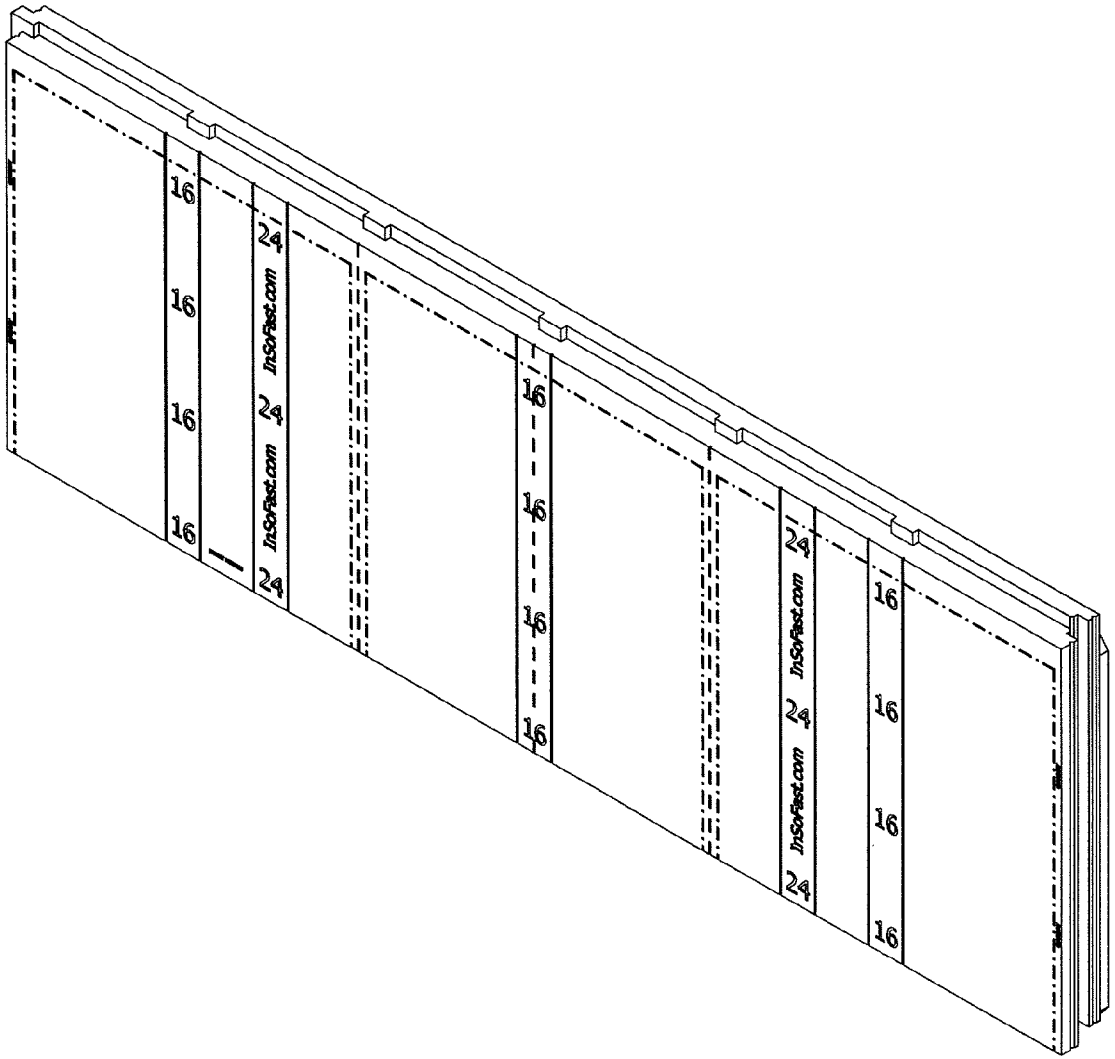
FIG. 21 is a front perspective view of a panel for the system shown in FIGS. 12-16.
Figure 22:
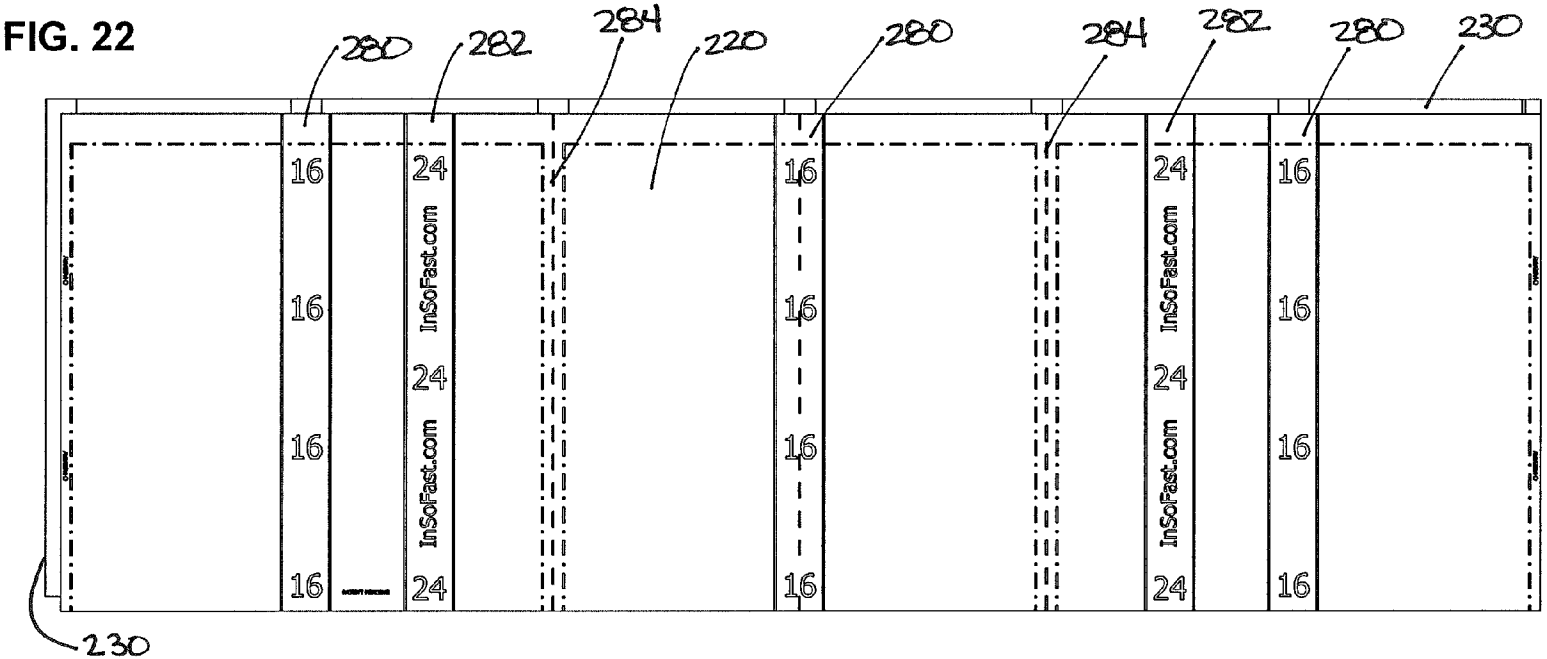
FIG. 22 is a front elevational view of the panel shown in FIG. 21.
Figure 24:
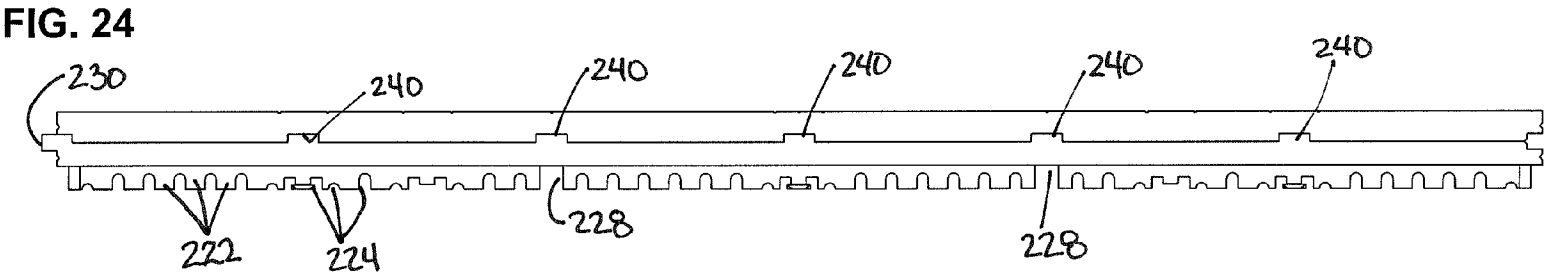
FIG. 24 is a bottom plan view of the panel shown in FIG. 21.
Figure 23:
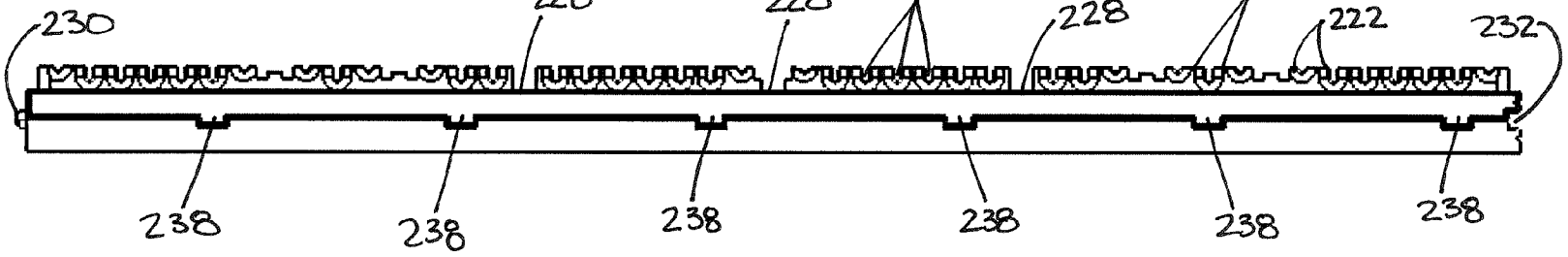
FIG. 23 is a top plan view of the panel shown in FIG. 21.
Figure 26:
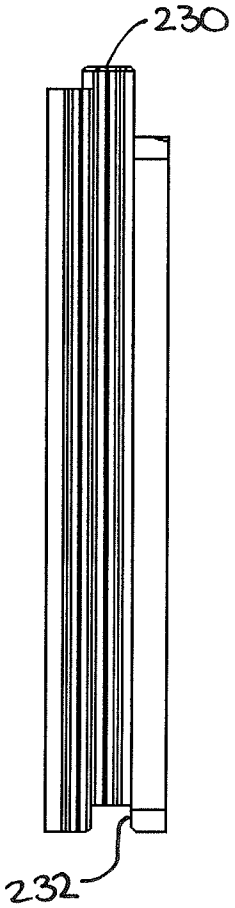
FIG. 26 is a right side elevational view of the panel shown in FIG. 21.
Figure 25:
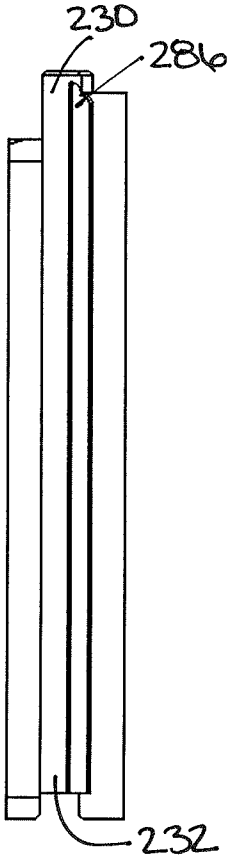
FIG. 25 is a left side elevational view of the panel shown in FIG. 21.

Referring now to FIGS. 16-20, the panels 220 are also advantageously configured for directing water along the edges of the panels 220 and away from the front and rear faces directing water along edges of panel 220 and back toward the front or rear faces, keeping moisture from penetrating through the panel from either direction. Capillary channels are formed near and along the tongues 230 and grooves 232 that allow moisture to pass through the capillary openings spaced away from the front or rear faces, thereby reducing the likelihood of damage to other wall elements due to water and moisture. Added benefits regarding reduced formation of mold and mildew are also accomplished. The edges of the panels 220 with the grooves 232 include capillary break channels 246 formed in the panel edge and extend parallel to the groove 232. In addition, at the inner portion of each groove 232 is a channel 248. Moreover, the tongue 230 includes chamfers 242 that form the space allowing the capillary channel to form when engaging the groove 232. It can be appreciated that such V-shaped breaks are easily formed in the molded panels and create gaps to direct moisture along the edges and back toward the faces of the panels 220. These capillary channels redirect moisture from the front face back toward the front face and moisture from the back face back toward the back fact. This keeps water from migrating through the panel 220 in either direction and away from drywall and other layers susceptible to moisture damage when used in a basement application or from migrating inward to the wall cavity when used in an exterior wall application such as with stucco or siding. The drainage channels on the back of the panels 220 drain moisture from wall cavities to exterior weep screeds. As shown in FIGS. 17, 19 and 25, flashing 286 may extend up and along the edge of the groove 230 to provide further engagement with the complementary edges of the panels 220.

Figure 61:
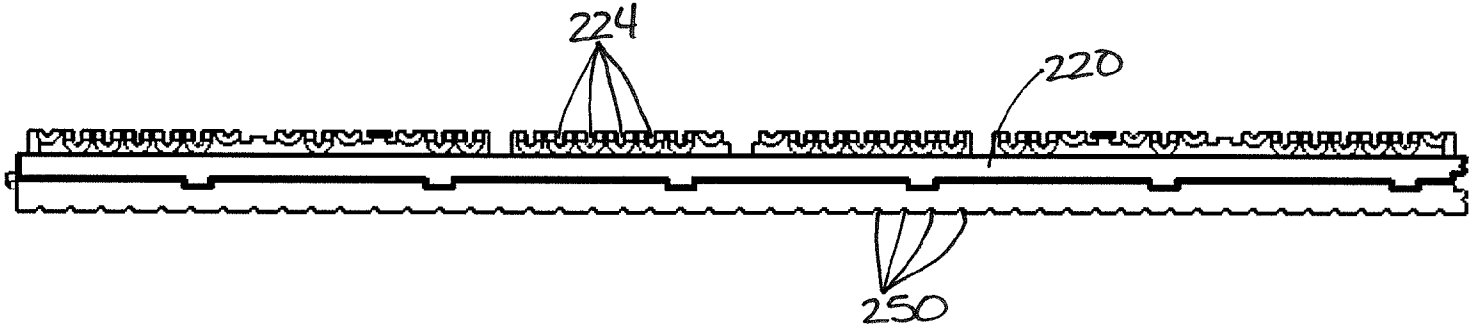
FIG. 61 is a top plan view of a panel having a first embodiment of surface drainage channels formed on a front face of the face.
Figure 62:
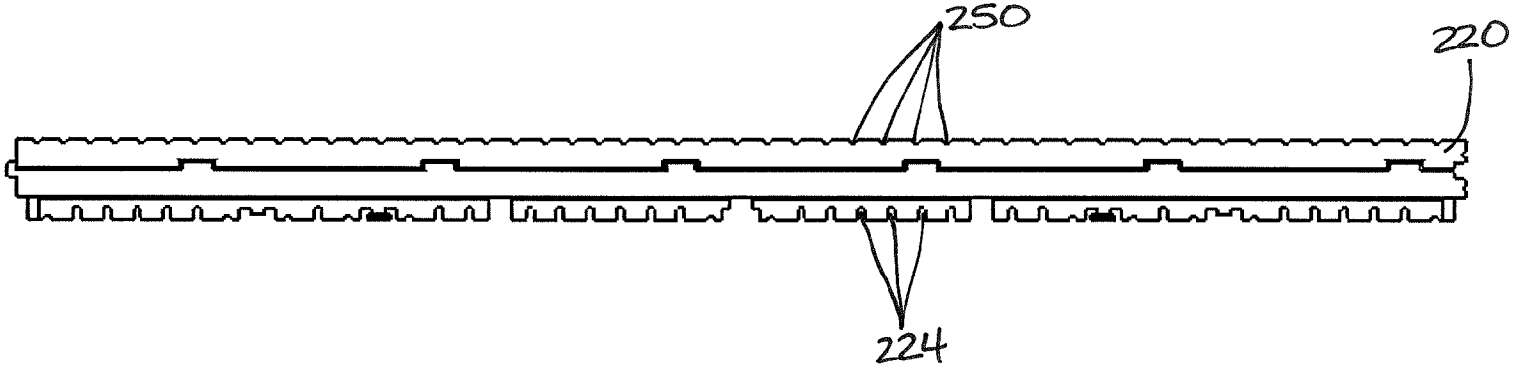
FIG. 62 is a bottom plan view of the panel shown in FIG. 61.
Figure 63:
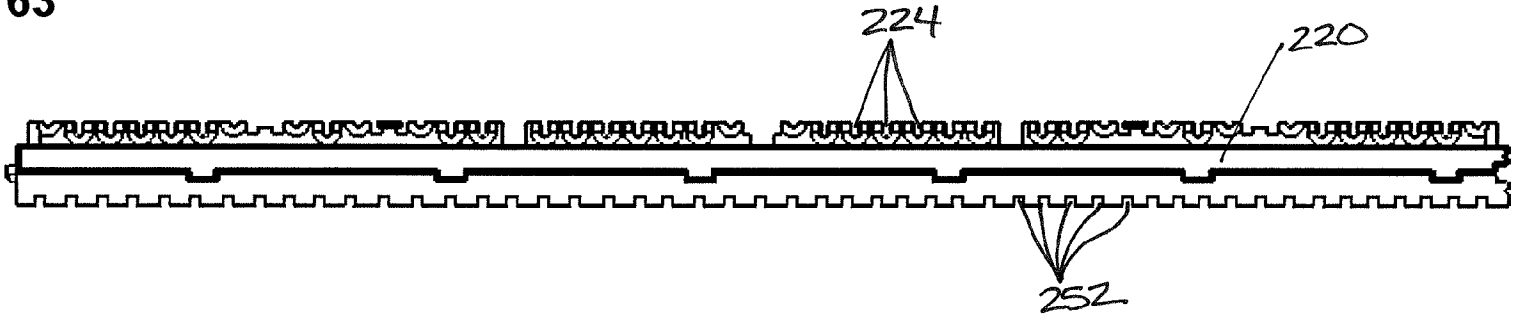
FIG. 63 is a top plan view of a panel having a second embodiment of surface drainage channels formed on a front face of the face.
Figure 64:
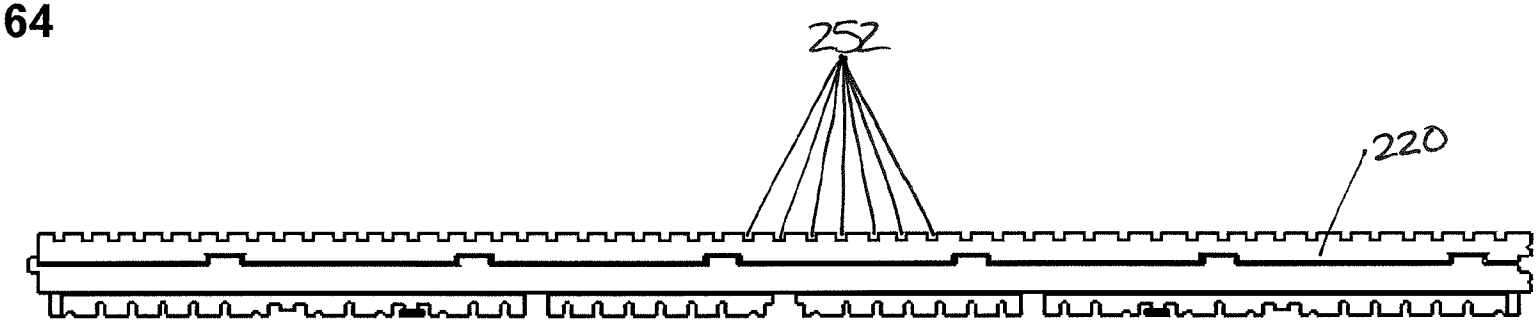
FIG. 64 is a bottom plan view of the panel shown in FIG. 63.

As shown in FIGS. 61-64, both faces of the panels 220 may include surface drainage channels. In addition to channels 224 on the inner face, the outer or front face of the panels 220 may include drainage channels 250 as shown in FIGS. 61 and 62 or deeper channels 252 as shown in FIGS. 63 and 64. The channels 250 or 252 provide recessed drainage along the front face to keep water away from moisture sensitive layers in the wall.

Figure 75:
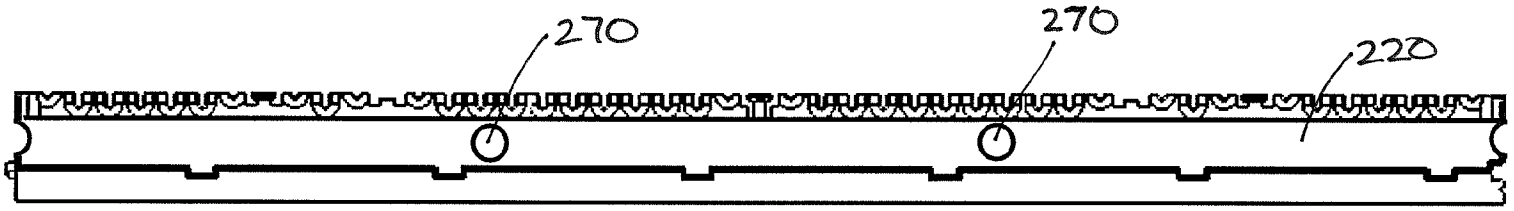
FIG. 75 is a top plan view of a panel having embedded utility chases.
Figure 76:
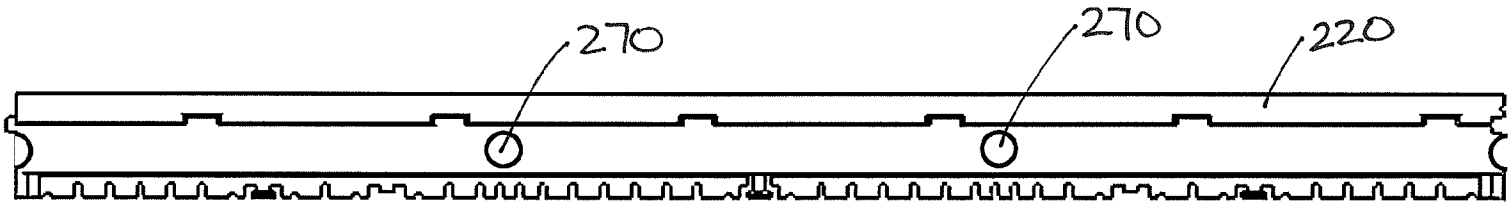
FIG. 76 is a bottom plan view of the panel shown in FIG. 75.
Figure 77:
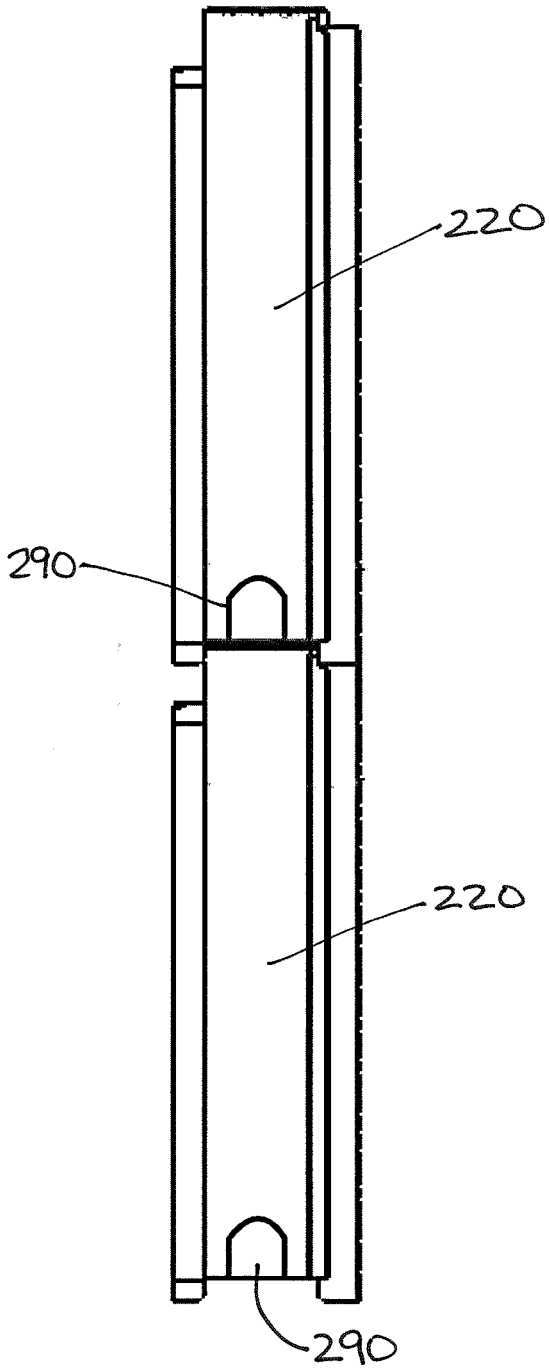
FIG. 77 is a side detail view of an assembly of two panels forming a horizontal utility chase.

As shown in FIGS. 75-76, the panels 220 may include embedded utility chases 270. The embedded chases provide for routing utility lines through the interior of the panels 220 and may be used in conjunction with other chases on the faces of the panels 220. In addition, as shown in FIG. 77, the top and bottom edges of the panels may be configured to define horizontal embedded utility chases 290 between adjacent top and bottom edges. The horizontal embedded utility chases 290 may be used with the other outer and embedded chases to provide superior routing flexibility.

Figure 27:
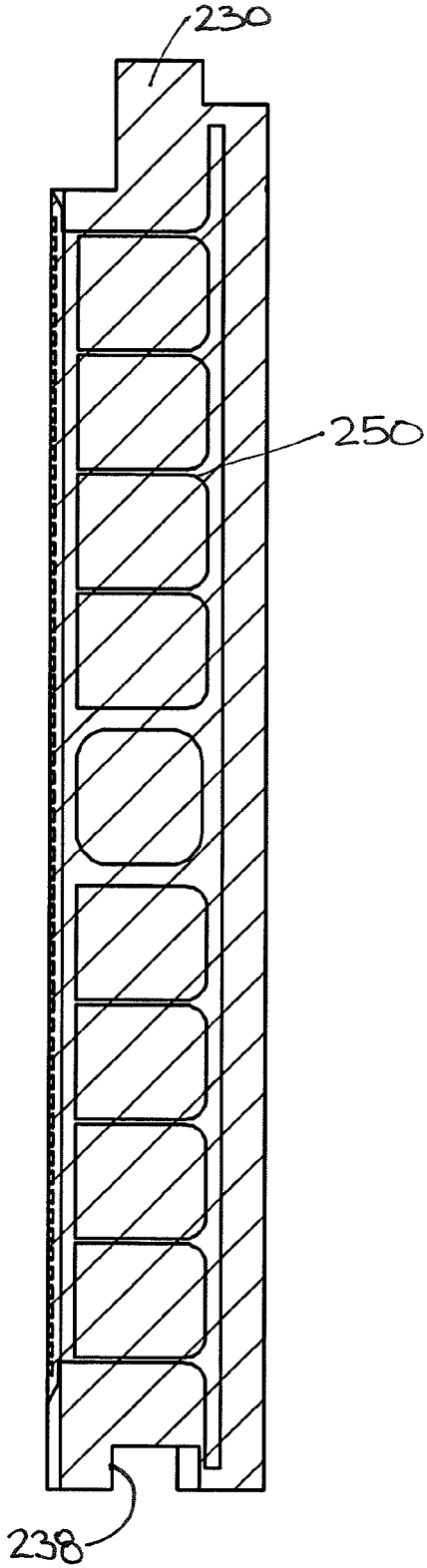
FIG. 27 is a sectional view taken along line 27-27 of FIG. 21.
Figure 28:
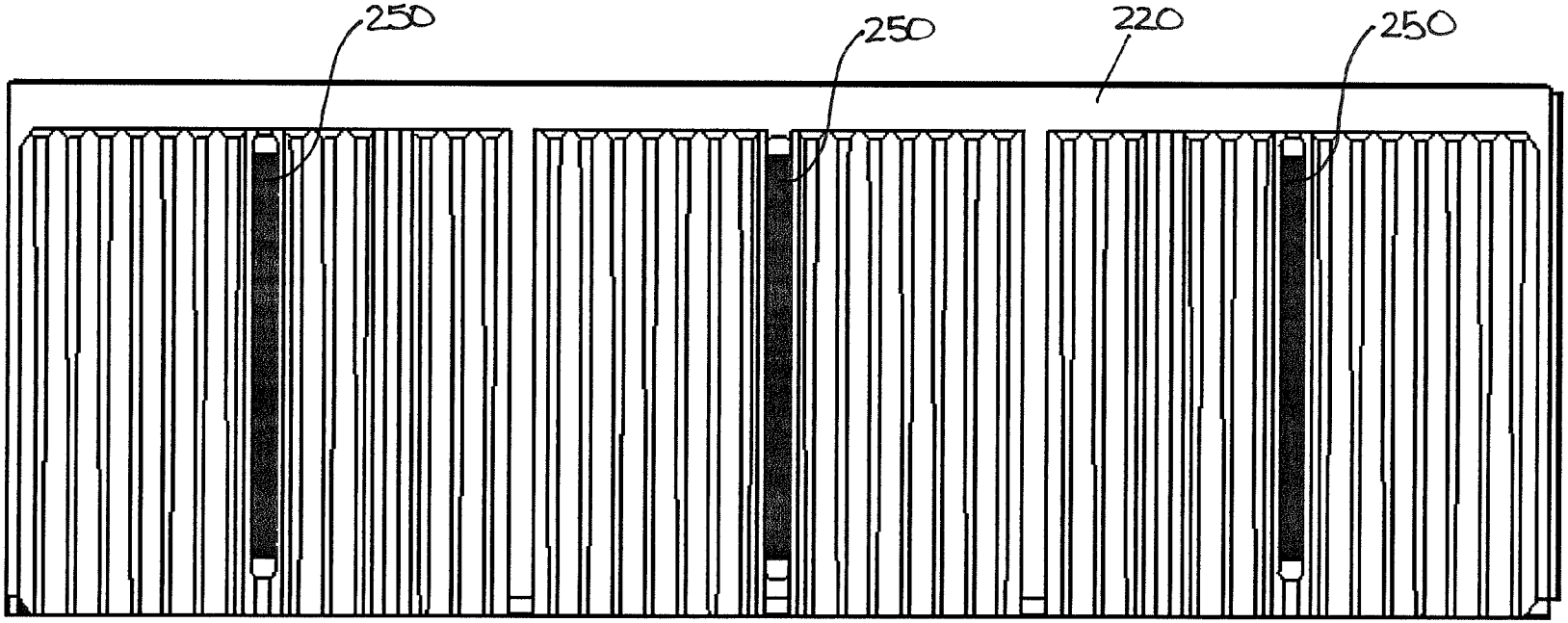
FIG. 28 is a rear elevational view of the panel shown in FIG. 21 with mounting studs embedded in the panel spaced for the assembly shown in FIG. 12.
Figure 29:
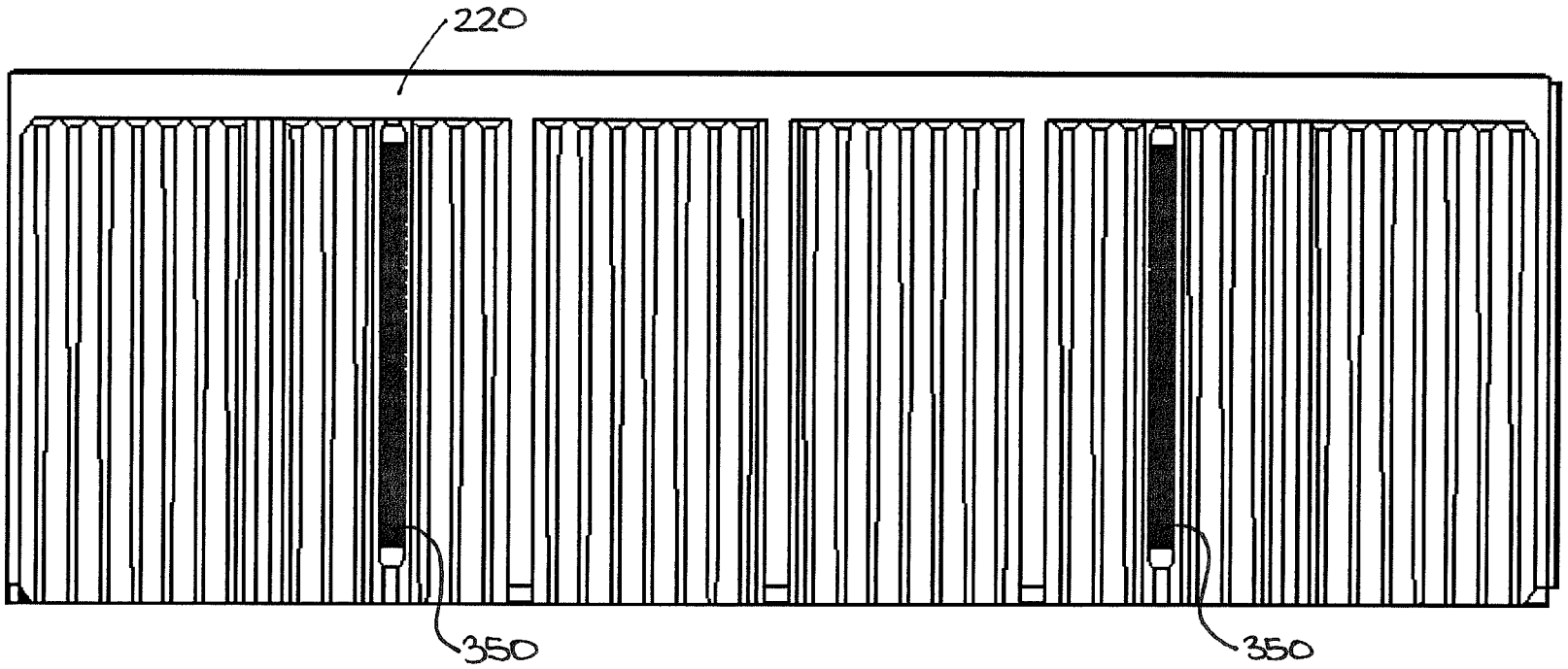
FIG. 29 is a rear elevational view of the panel shown in FIG. 21 with mounting studs embedded in the panel spaced for the assembly shown in FIG. 14.
Figure 30:
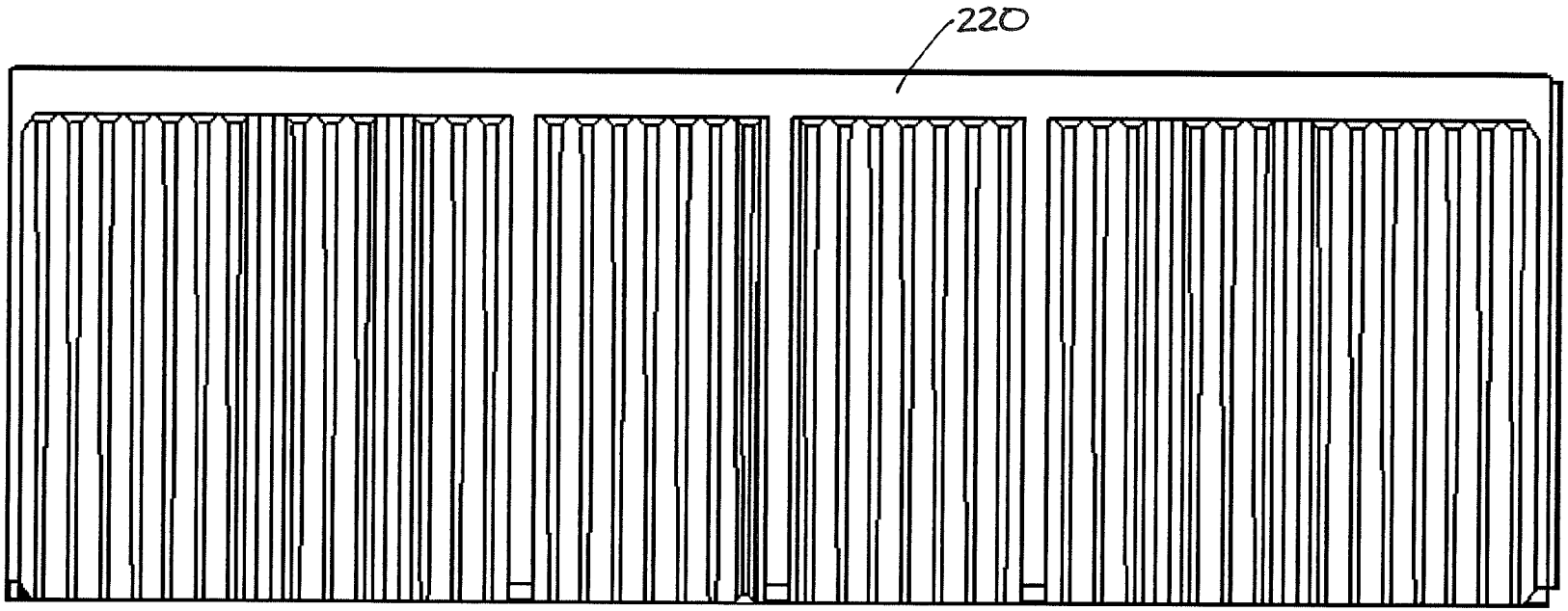
FIG. 30 is a rear elevational view of the panel shown in FIG. 21 without mounting studs embedded in the panel.

Referring now to FIGS. 27-30, the panels 220 include embedded mounting elements or studs 250 in some configurations. As shown in FIG. 30, for some applications, mounting elements may not be required and the panels 220 are simply an insulation layer with no mounting required. The panels 220 fit together in the same manner as other configurations that include mounting studs. The offset for such panels has great flexibility as no alignment of studs is required. Typical offsets are 8, 16 and 24 inches. As shown in FIG. 27, when the panels include the mounting elements 250, the mounting elements 250 are recessed from the first face and hidden from view. Locations for the mounting studs 250 can be determined from the indicia 280 or 282 as discussed above and shown for example in FIG. 22. As can be seen when viewed from the back, the mounting studs may be placed on 16 inch centers such as shown in FIG. 28, or another standard spacing on 24 inch centers, such as shown in FIG. 29 and using mounting elements 350. However, it can be appreciated that other configurations could also be utilized with the studs molded into the panels 220 at the preselected spacing.

Figure 65:
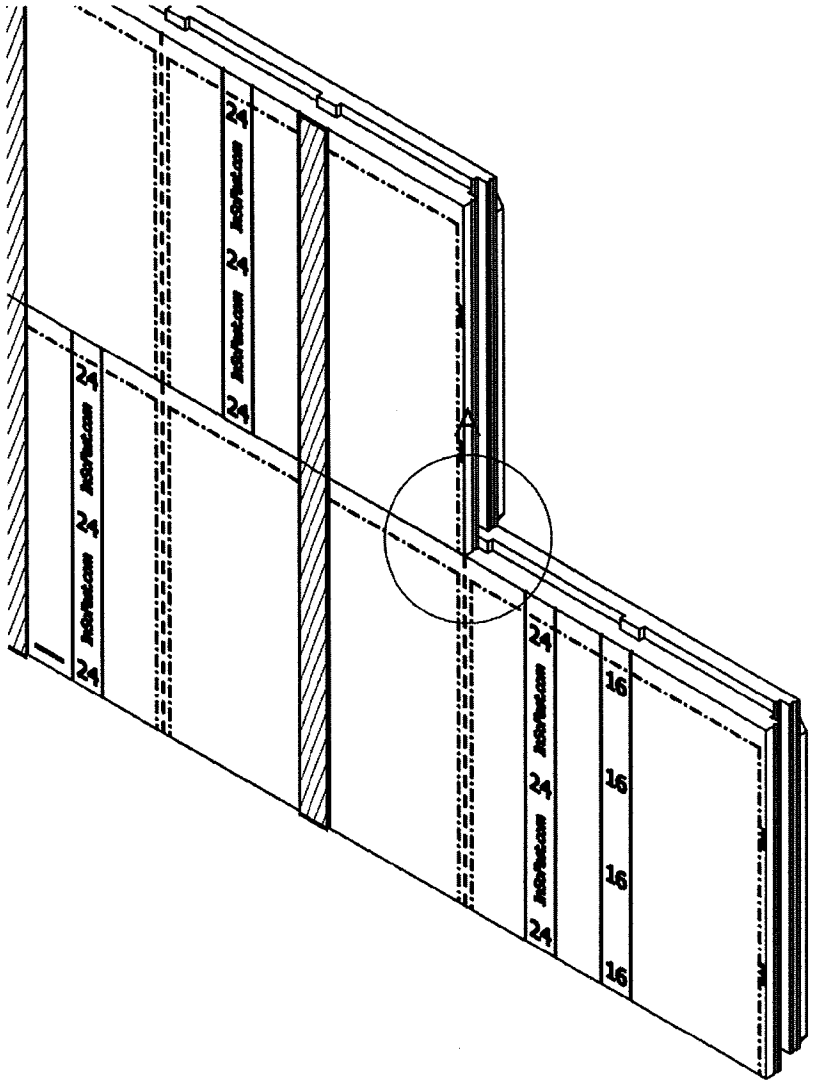
FIG. 65 is a perspective view of a portion of an insulation system utilizing panels having protruding mounting elements.
Figure 66:
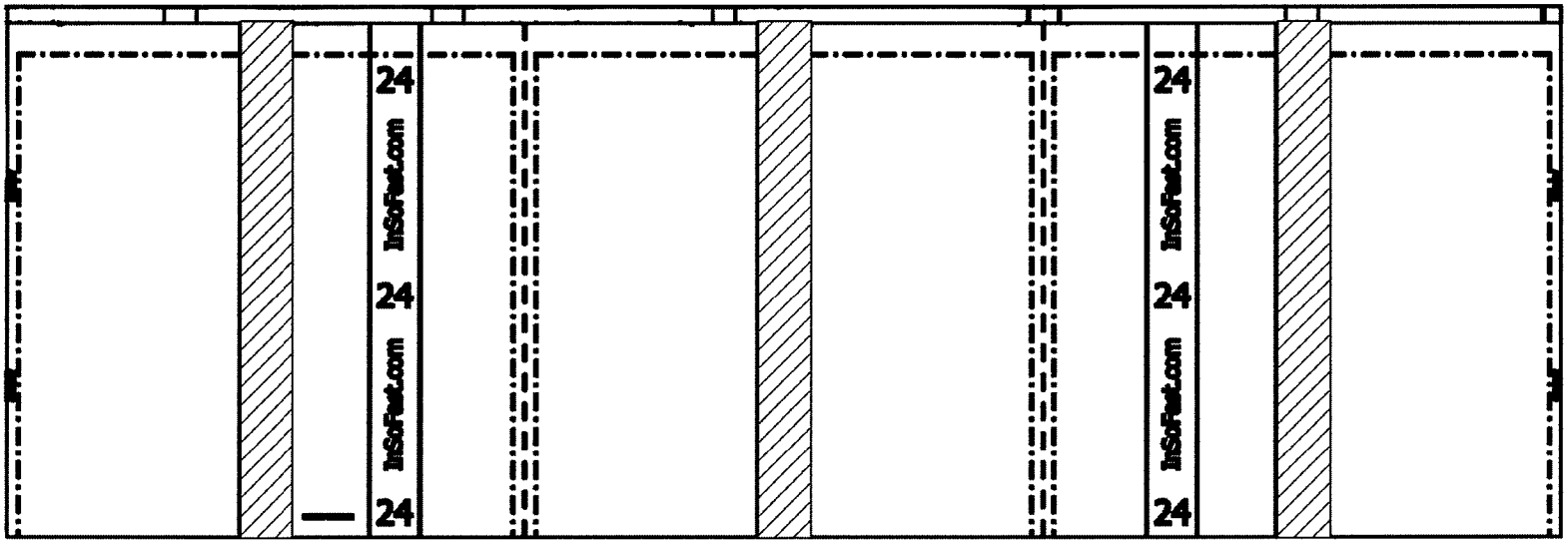
FIG. 66 is a front elevational view of a panel for the system shown in FIG. 65.
Figure 67:
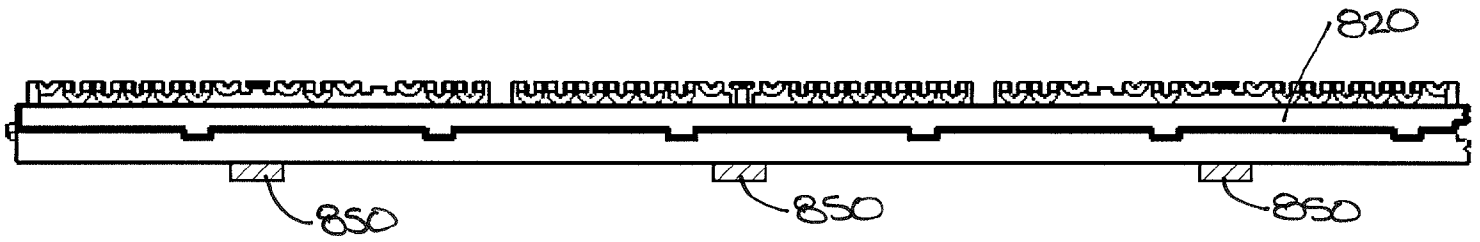
FIG. 67 is a top plan view of the panel shown in FIG. 66.
Figure 68:
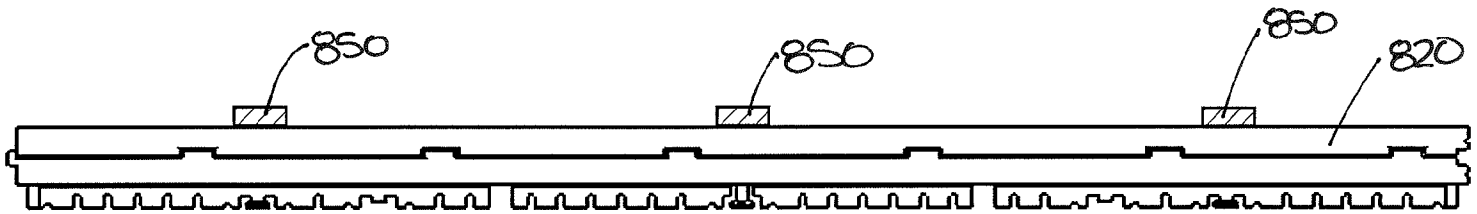
FIG. 68 is a bottom plan view of the panel shown in FIG. 66.
Figure 71:
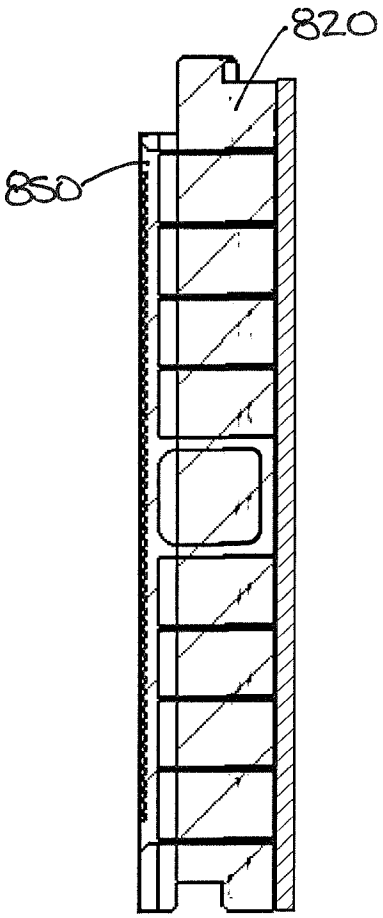
FIG. 71 is a sectional view taken through a mounting stud of the panel shown in FIG. 66.
Figure 70:
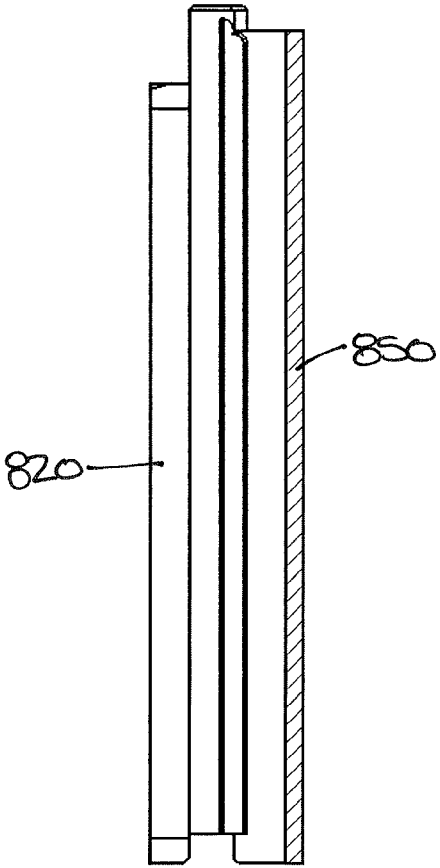
FIG. 70 is a left end elevational view of the panel shown in FIG. 66.
Figure 69:
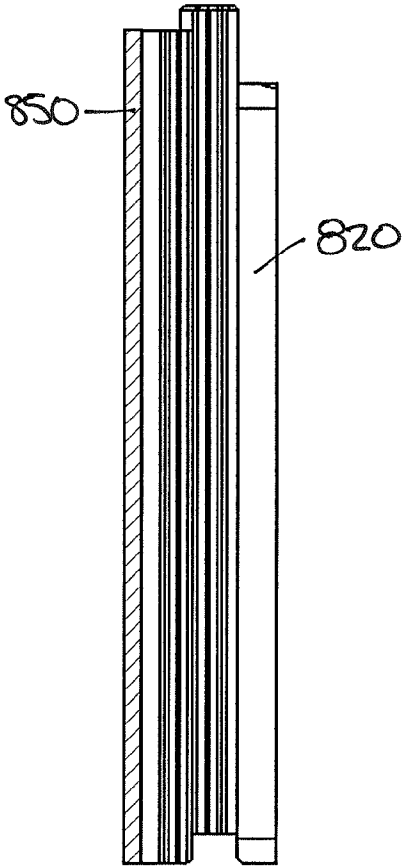
FIG. 69 is a right end elevational view of the panel shown in FIG. 66.

Referring now to FIG. 65, there is shown an assembly 800 of a further embodiment of panels 820. As shown in FIGS. 66-71, the panels 820 are similar to the panels 220, but include protruding mounting elements 850. The mounting elements 850 extend outward beyond the front face of the panels 820 and provide visible and easily accessible mounting surfaces. The protruding mounting elements 850 define a drainage plane along the front face when the panels 820 are installed to allow water to drain along the face of the moisture resistant panels 820 without causing damage to other layers and materials in the wall. Such a protruding configuration is especially suited for stucco, cement based siding or other siding installations and creates a full rain screen on the front face of the panel 820.

Figure 72:
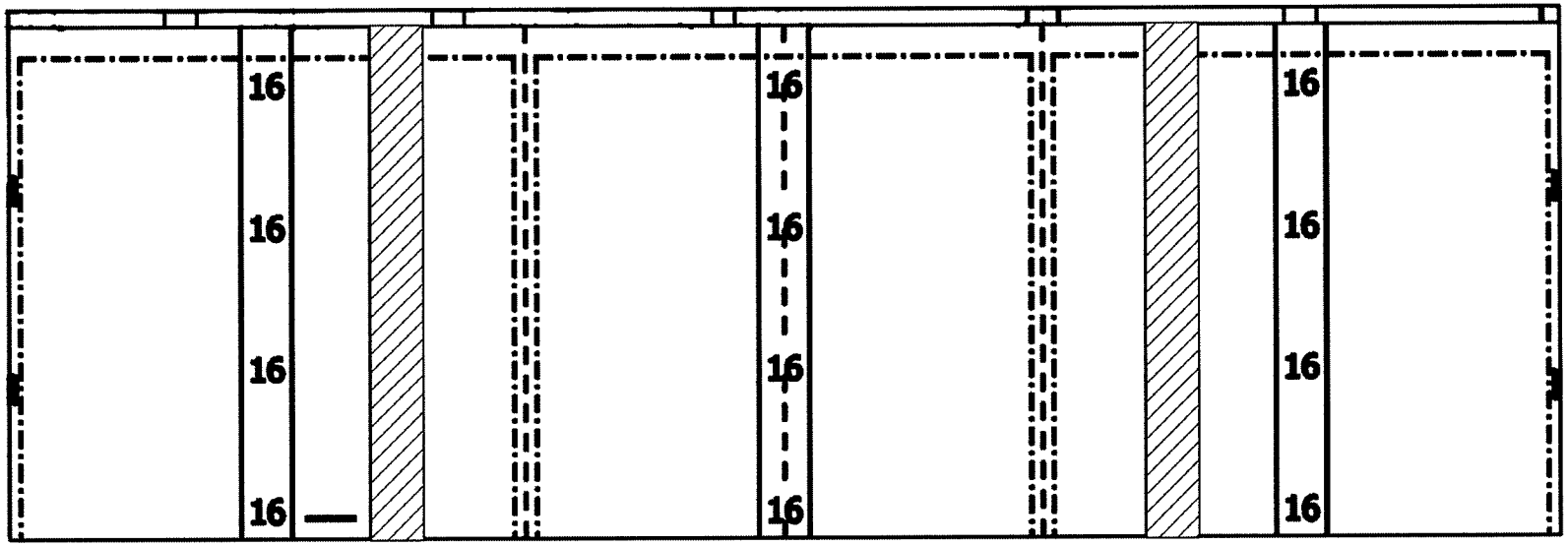
FIG. 72 is a front elevational view of a panel for the system shown in FIG. 65 with the protruding studs set at a different distance apart.
Figure 73:
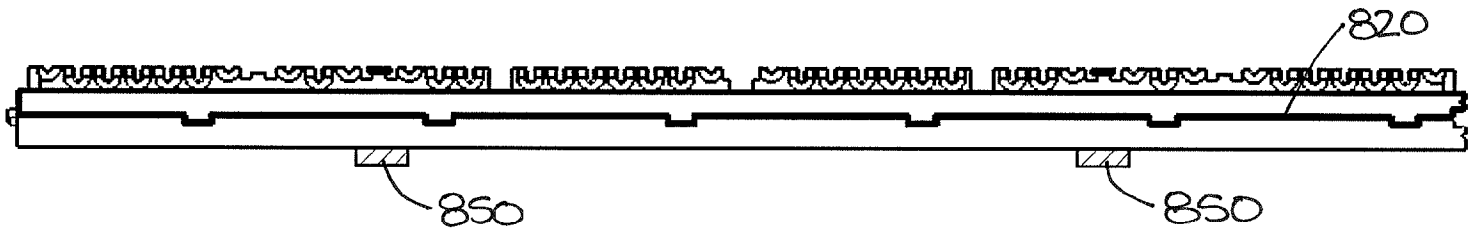
FIG. 73 is a top plan view of the panel shown in FIG. 72.
Figure 74:
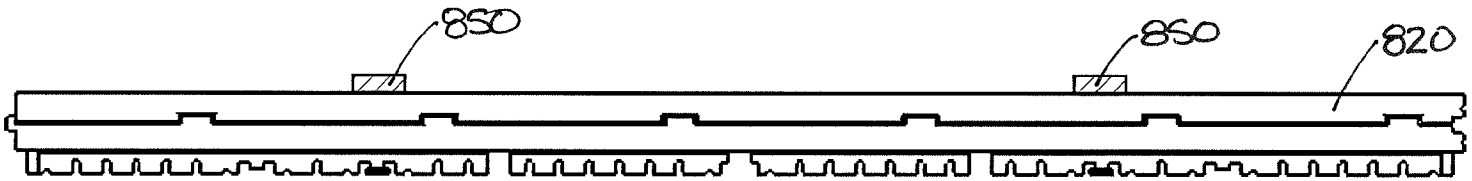
FIG. 74 is a bottom plan view of the panel shown in FIG. 72.

Although the mounting elements 850 are configured to protrude beyond the front face, the mounting elements are embedded in a manner similar to the other mounting element embodiments described herein and may include similar features for receiving adhesive as also described herein. Moreover, the mounting elements 850 may be spaced on different centers such as 24 inch centers shown in FIGS. 72-74.

Referring now FIGS. 35-42, there is shown another embodiment of a mounting element, designated 250. Element 250 includes a first planar mounting portion 252, a second mounting portion 260 and connecting ribs 254 extending between the first mounting portion 252 and the second mounting portion 260. The ribs 254 extend transversely to the longitudinal direction of the mounting element and perpendicular to the first mounting portion 252 and the second mounting portion 260. Flanges 256 also extend along the second mounting portion 260 and around a central opening formed between two central ribs 254. The resulting configuration of the mounting element 250 provides a lightweight and surprisingly high strength element to provide additional support to the mounting panels 220.

The mounting element 250 is embedded in the foam panel 220 or at least partially embedded in the foam panel 220 and transfers lateral shear forces from the outside face through ribs 254 to the foam and mounting portion 260 and into the wall. The mounting element 250 is at least partially surrounded by the foam and relies for some support from the foam. It can be appreciated that the mounting elements 250 are embedded in the panels 220 and the expanded foam extends through the openings formed by the first and second mounting portions 252 and 260 and connecting ribs 254 to provide a strong mechanical interlock for anchoring the elements 250. In addition, the second mounting portion has dovetail portions 262 formed therein that provide an additional mechanical lock with the adhesive. The dovetail portions 262 include a widened portion 264 and a neck portion 266 along the bottom of the second mounting portion, as shown most clearly in FIG. 42. In addition, a second neck portion 268 extends up from the widened portion 264 to provide a further mechanical interlock with the adhesive. Adhesive may be forced onto one or more of the surfaces of the dovetails 262 or upper neck portion 268 to increase bonding with the mounting elements 250. When applied to the mounting portion 260, the adhesive fills the dovetail portions 262 and may extend into the second neck portions 268. The mold may require controls to ensure that the proper amount of adhesive is used. The neck portions 268 are configured so that the bead from the expanded foam is typically too large to extend into the neck portions 268 and a keyway or slot may be formed by a mold insert to provide an air pocket to improve curing and to ensure proper distribution. The added surface area speeds curing for the adhesive, which forms widened flange like portions that provide a mechanical engagement with the dovetail portions. The dovetails extend transversely to the longitudinal direction of the mounting element 250 along substantially the entire length of the second mounting portion 260 to provide a large degree of mechanical interlock with the adhesive.

As shown in FIG. 27, the mounting element 250 may be embedded with the first mounting portion 252 recessed from the first face of the panel 220. The second mounting portion 260 may extend through to the rear face of the panel 220. The dovetails 262 may be configured for receiving adhesive for attaching the panels 220 to a mounting surface. The various surfaces of the dovetails 262 provide greater surface area and multiple mechanical interlocks with the adhesive so that when cured, a strong bond is made between the dovetails 262 and the mounting surface to provide secure attachment of the panels 220 to a mounting surface.

Figure 47:
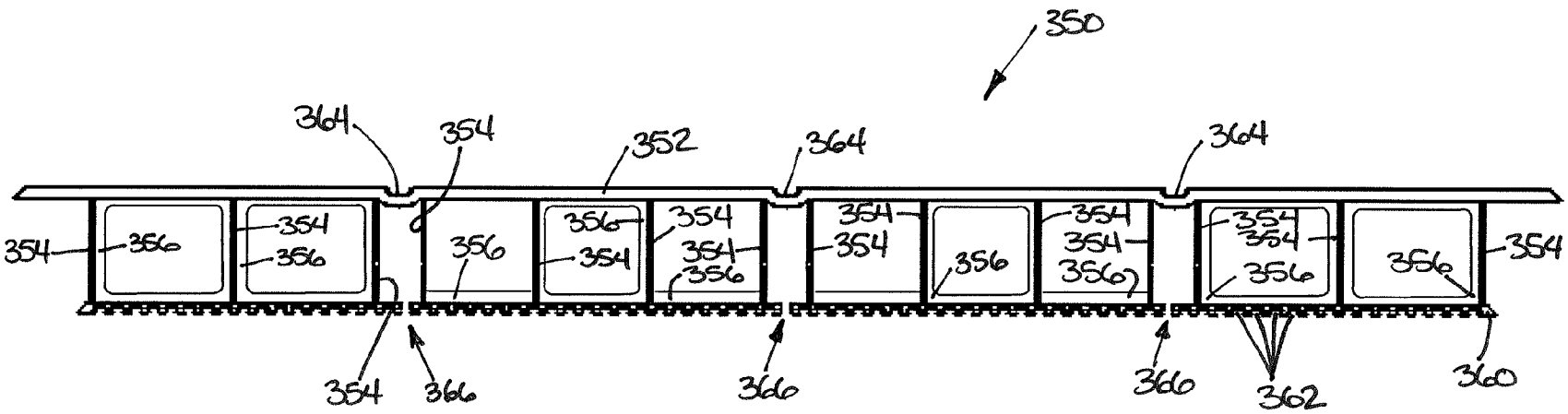
FIG. 47 is a front elevational view of the mounting stud shown in FIG. 43 with shrinkage gaps formed in the stud.
Figure 48:
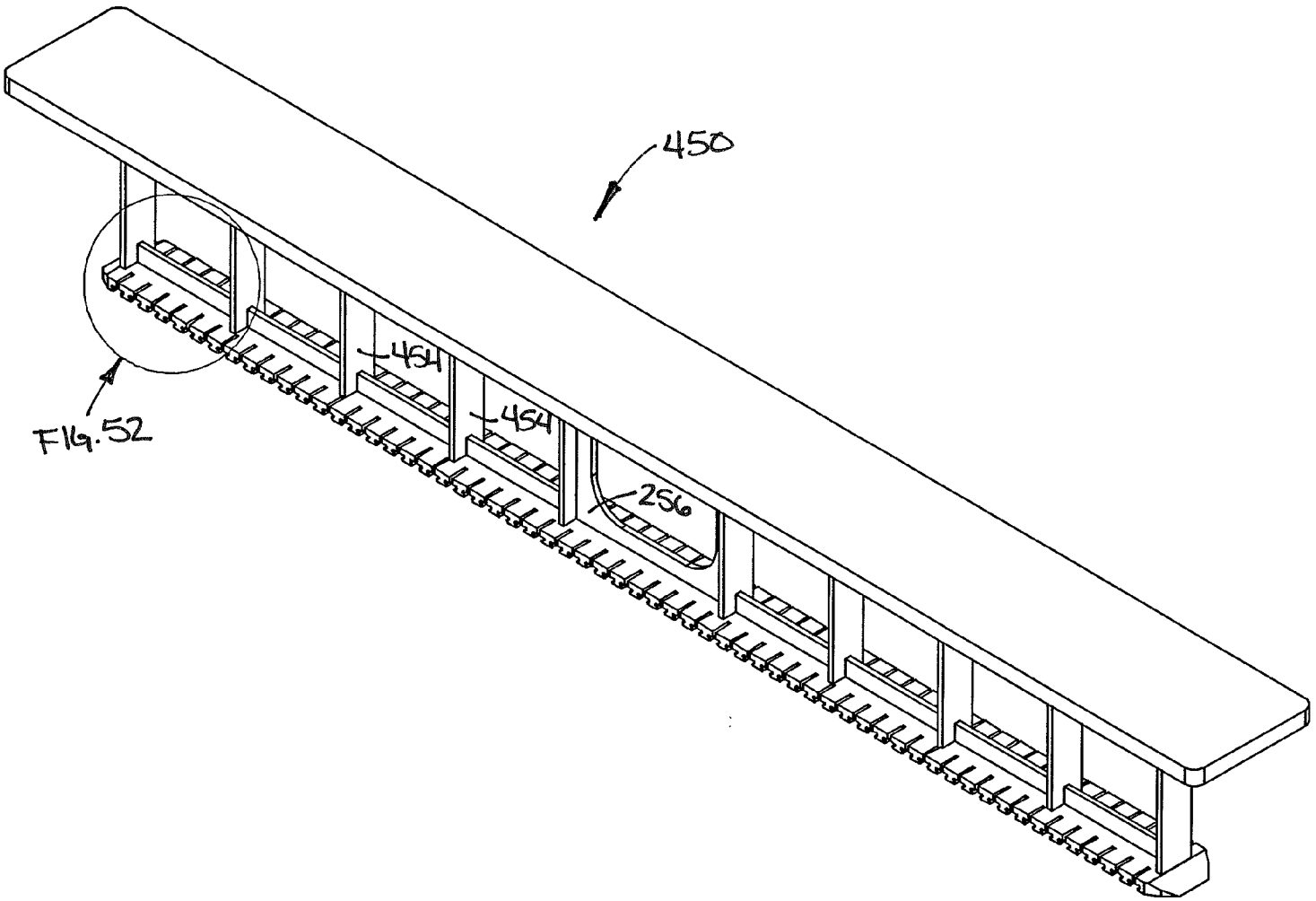
FIG. 48 is a perspective view for a mounting stud embedded in the panels for the system shown in FIG. 14.
Figure 49:
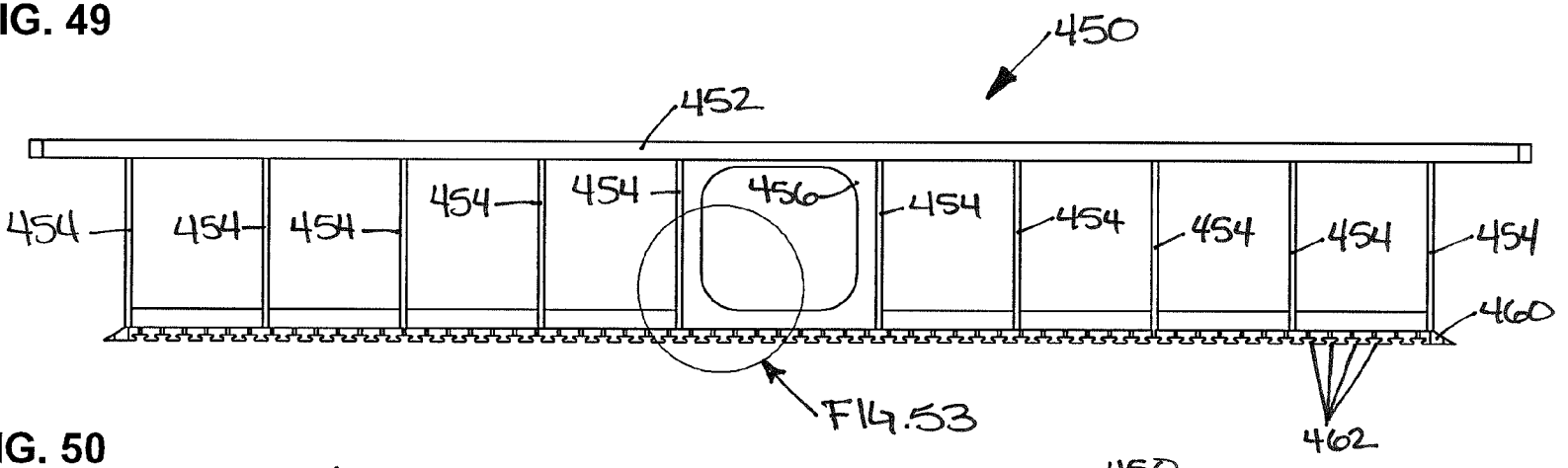
FIG. 49 is a side elevational view of the mounting stud shown in FIG. 48.
Figure 50:
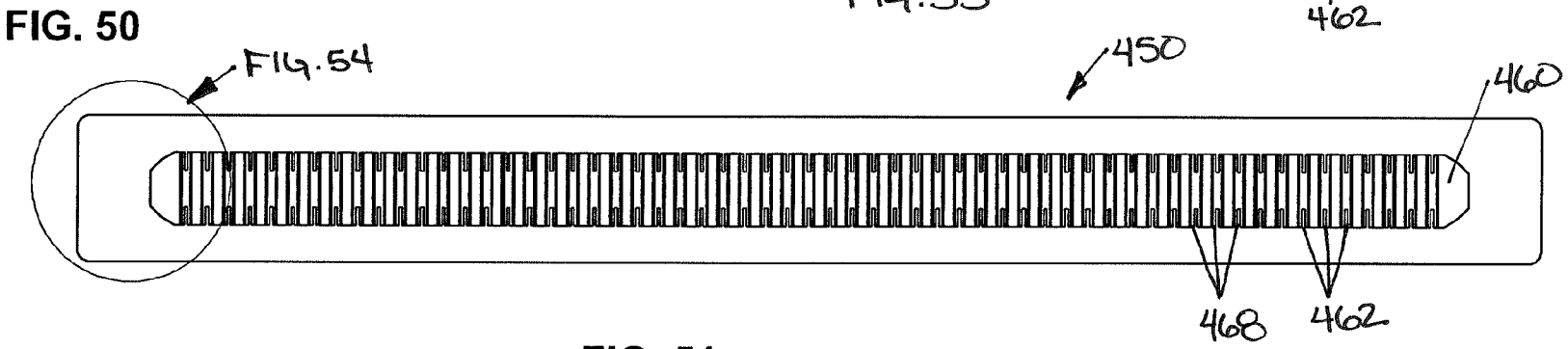
FIG. 50 is a bottom plan view of the mounting stud shown in FIG. 48.
Figure 51:
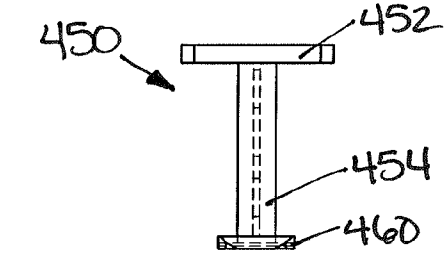
FIG. 51 is an end view of the mounting stud shown in FIG. 48.
Figure 52:
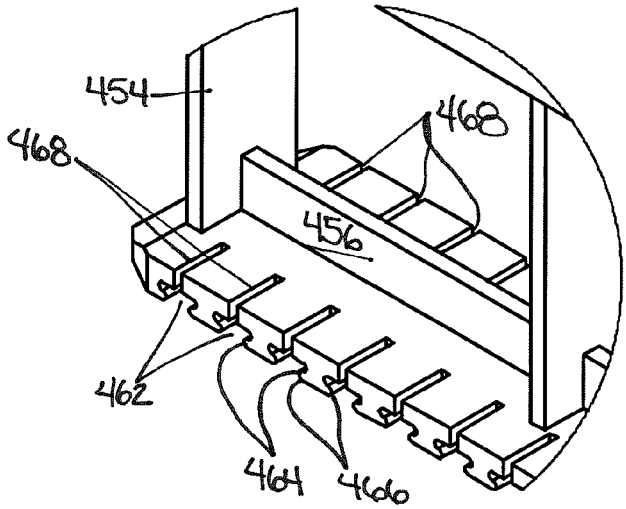
FIG. 52 is a detail perspective view of the dovetail connection portions for the mounting stud shown in FIG. 48.
Figure 53:
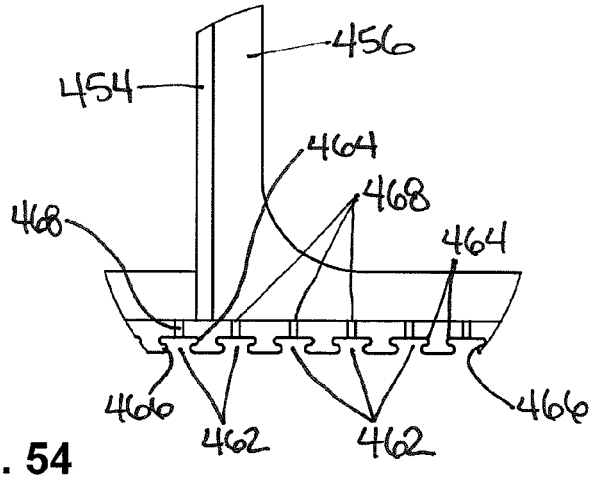
FIG. 53 is a detail side view of the dovetail connection portions shown in FIG. 52.
Figure 54:
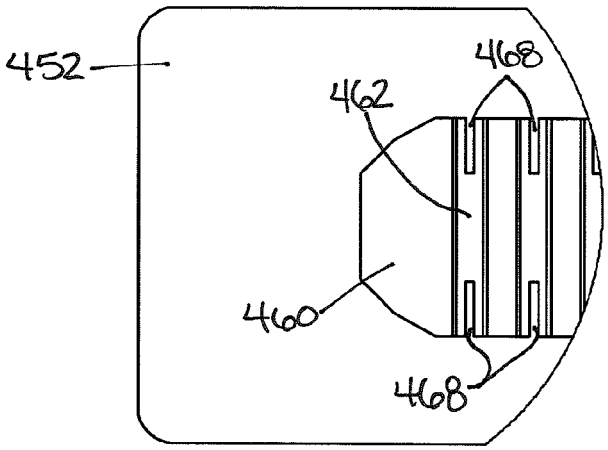
FIG. 54 is a detail bottom view of the dovetail connection portions shown in FIG. 52.

Referring now to FIGS. 43-47, there is shown a further embodiment with a mounting element, generally designated 350. The mounting element 350 includes a first mounting portion 352, a second mounting portion 360 and connecting ribs 354. The second mounting portion 360 includes dovetail type structures for forming mechanically interlocking surfaces for engaging adhesive in a manner similar to that described for the embodiment shown in FIGS. 36-42. The mounting element 350 may also include recesses 364 in the first mounting portion 352 that serve as recessed attachment locations for mechanical connectors so that nail or screw heads do not protrude beyond the face of the panel. The mounting element 350 may include cross braces between the connecting braces 354 with the cross braces 358 aligned with the recesses 364. As shown in FIG. 47, the mounting elements 350 may also include gaps 366 in the second mounting element that may accommodate differential shrinkage during molding of the stud 350.

Referring now to FIGS. 48-54, a further embodiment of a mounting element 450 is shown. The mounting element 450 includes a first mounting portion 452, a second mounting portion 460 and connecting ribs extending between the first mounting portion 452 and the second mounting portion 460. In addition, flanges may extend along the second mounting portions 460 between the ribs 454 and around a center opening between the connecting ribs 454, first mounting portion 452 and second mounting portion 460. The second mounting portion 460 includes dovetail structures 462, shown most clearly in FIGS. 52-54. The dovetails 462 include a widened portion 464 with a neck 466 extending downward to the bottom of the second mounting portion as viewed in FIG. 53. The dovetails 462 have angled surfaces extending from the widened portion 464 to the neck 466. In addition, extending upward from the top of the widened portion 464 are slots 468. The widened portion 464, neck 466, angled surfaces and slots 468 provide for a strong mechanical interlock between the mounting element 450 and adhesive.

Figure 55:
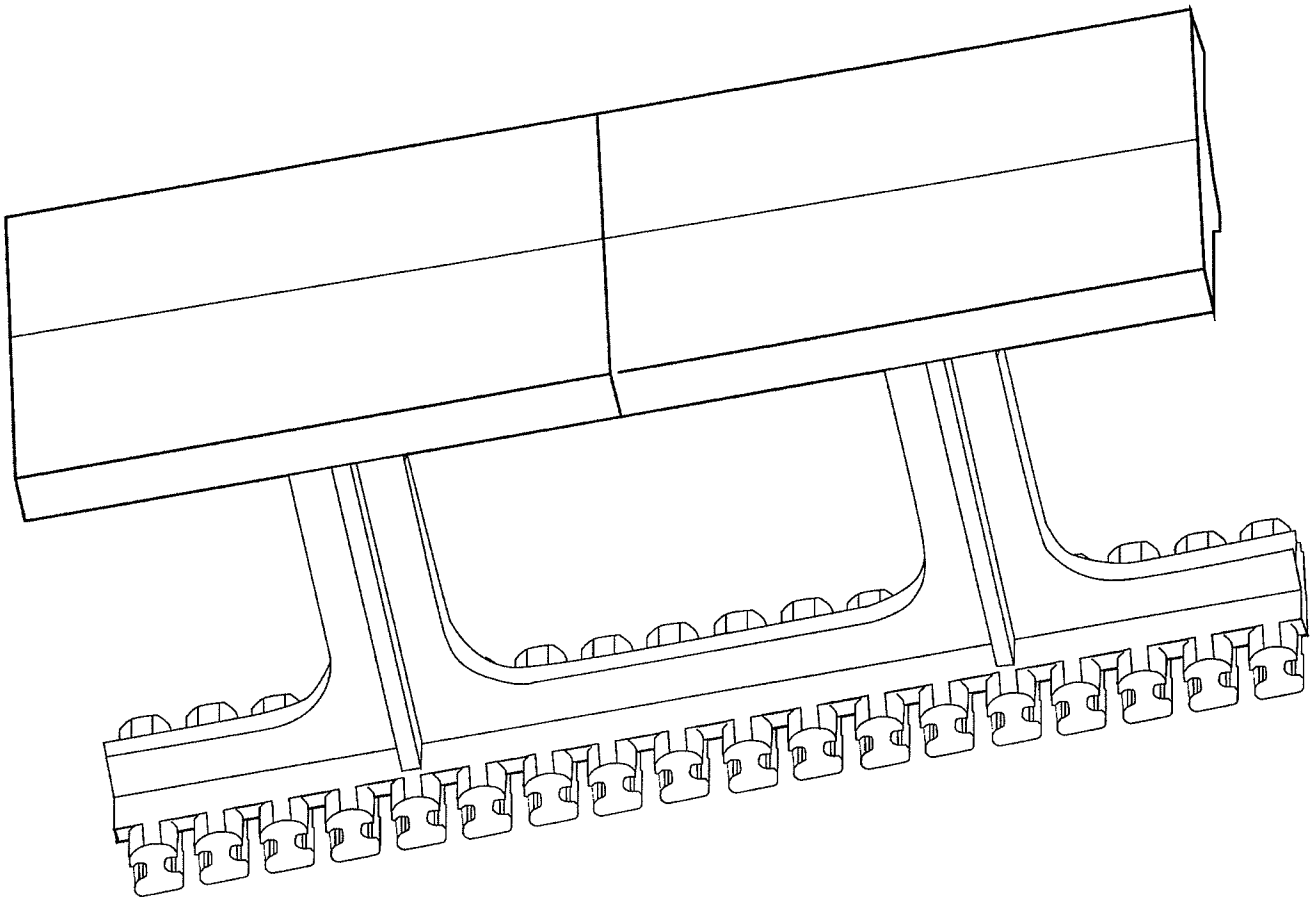
FIG. 55 is a detail perspective view of a first alternate embodiment of mounting stud dovetails.

Referring now to FIG. 55, there is shown yet a further embodiment of dovetails 562 for a mounting element 250. The dovetails 562 alternate with I-beam type portions 570 extending substantially along the length of the second mounting portion 260. The dovetails 562 include a widened portion 564 and a dovetail neck 566, extending down to the bottom surface of the second mounting portion 260. A neck 566 with angled sides extends upward from the widened portion 564. The I-beam profile of the portions 570 extending between the dovetails 562 create an advantageous interlocking series of surfaces that provide a strong mechanical engagement with adhesive and increases surface area to speed curing of the adhesive.

Figure 56:
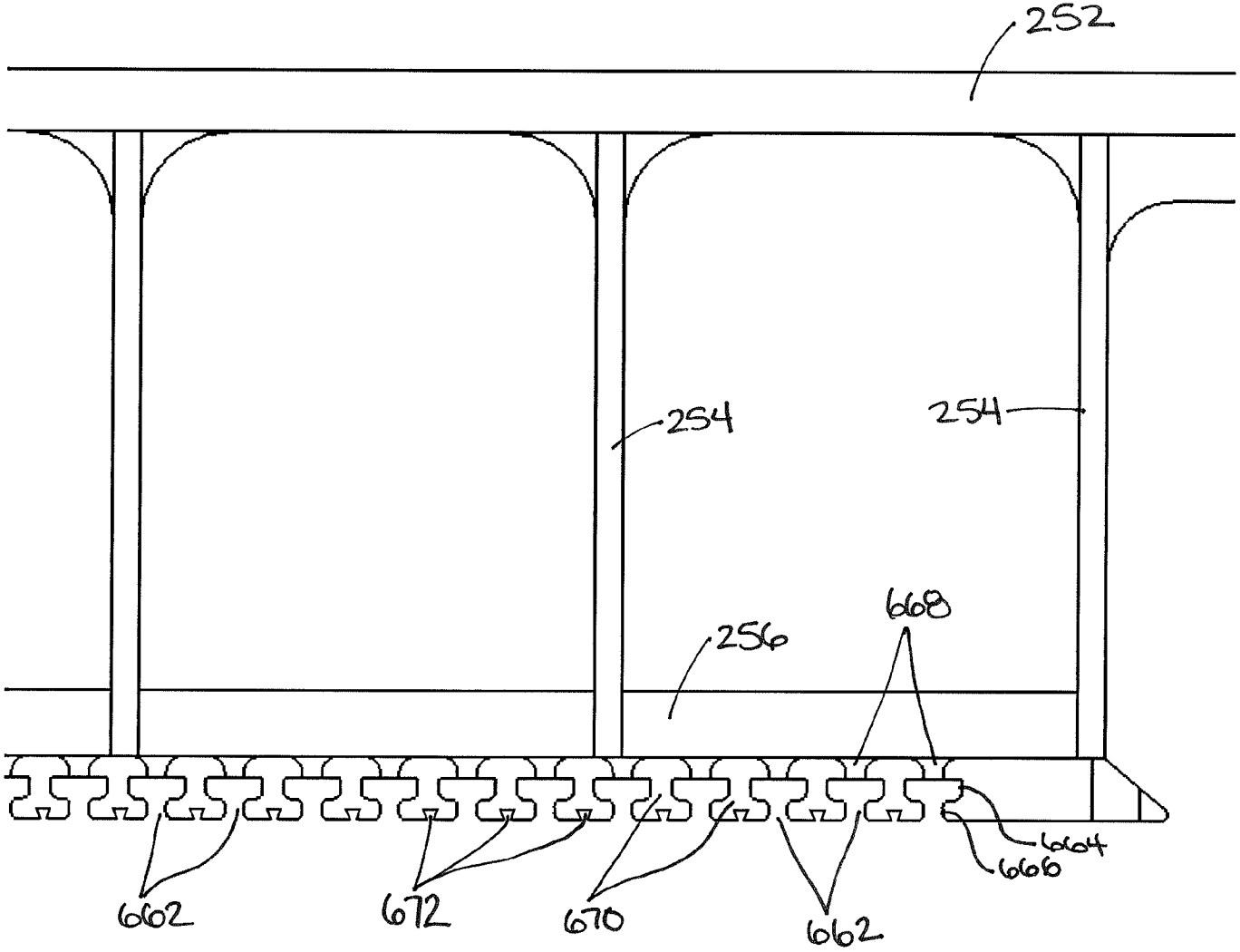
FIG. 56 is a side elevational view of a second embodiment of mounting stud dovetails.
Figure 57:
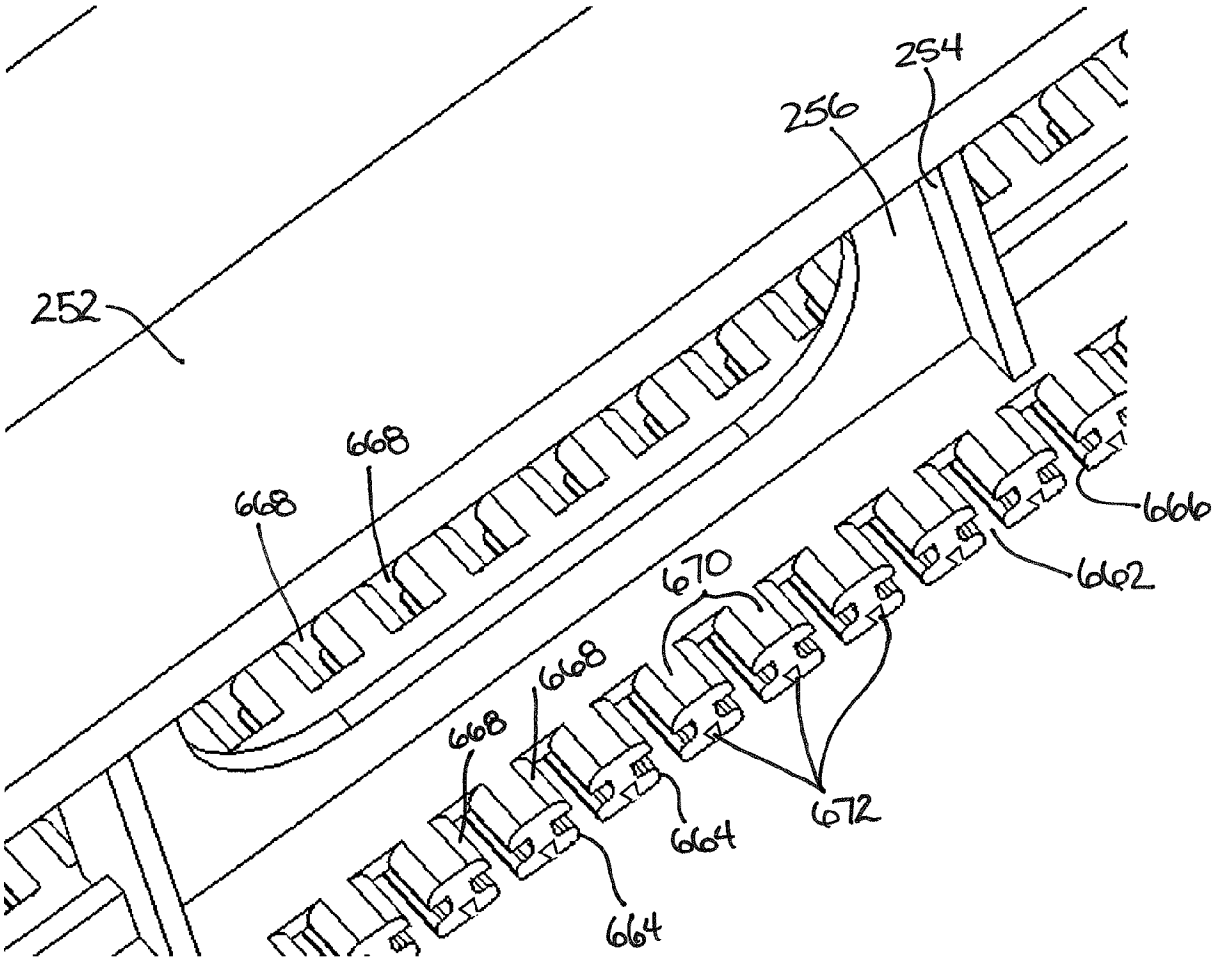
FIG. 57 is a perspective view of the mounting stud dovetails shown in FIG. 56.
Figure 58:
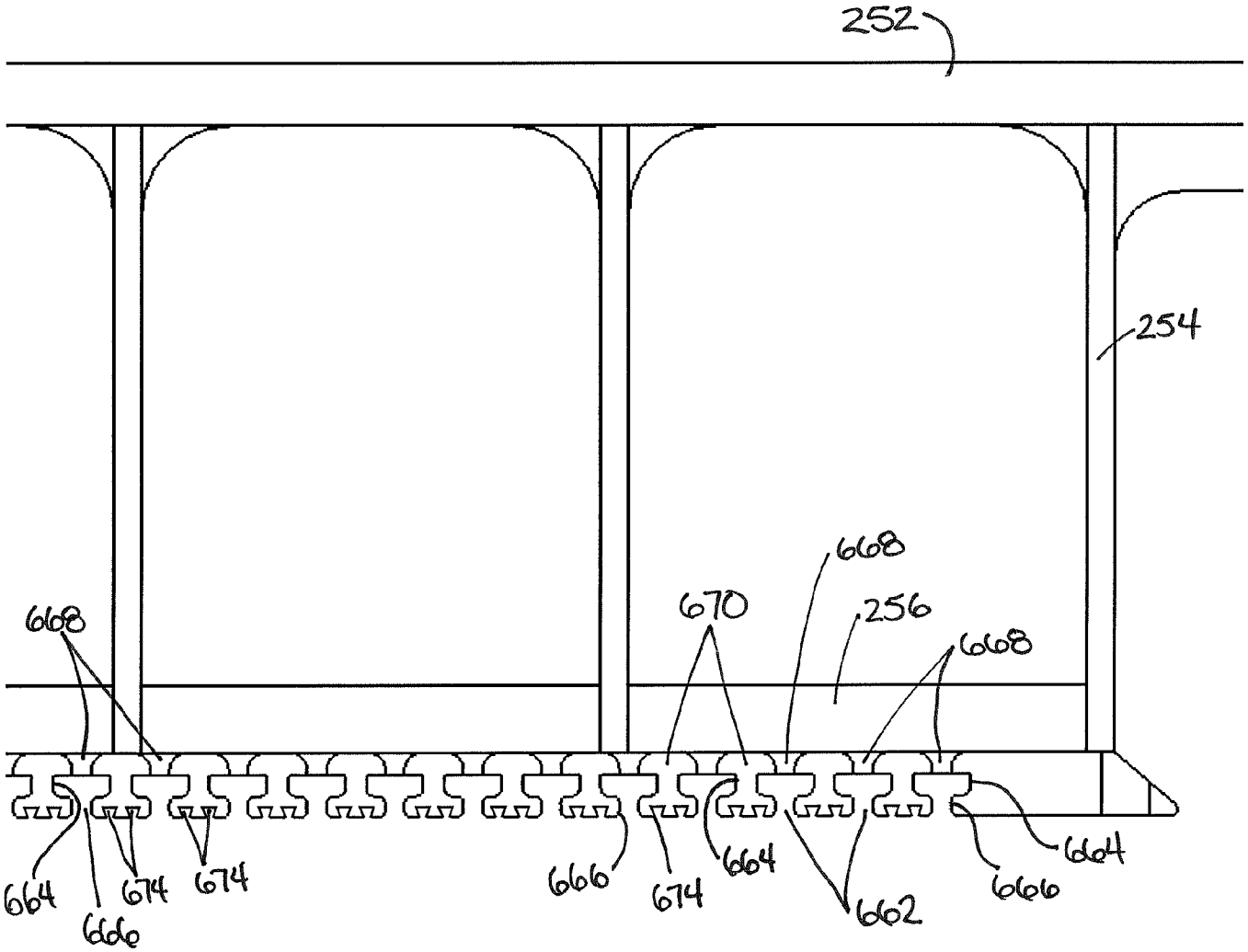
FIG. 58 is a side elevational view of a third embodiment of mounting stud dovetails.

Referring now to FIGS. 56-58, there is shown a further embodiment of dovetail structures 662. The dovetails 662 include a widened part 664 and a neck portion 666. An upper opening 668 includes curved surfaces that angle upward and widen. I-beam type profile portions 670 extend between the dovetails 662. The I-beam portions include rounded tops and bottom corners. In addition, a channel 672 extends parallel to the dovetail portions and along the bottom of each of the I-beam shaped profile elements 670, as shown in FIGS. 56 and 57. As shown in FIG. 58, the I-beam type portions 670 may include two parallel channels in one variation. The dovetails 662 and the I-beam profile portions 670 provide multiple surfaces, greater surface area and provide interlocking with the adhesive to improve attachment of the mounting element.

Figure 59:
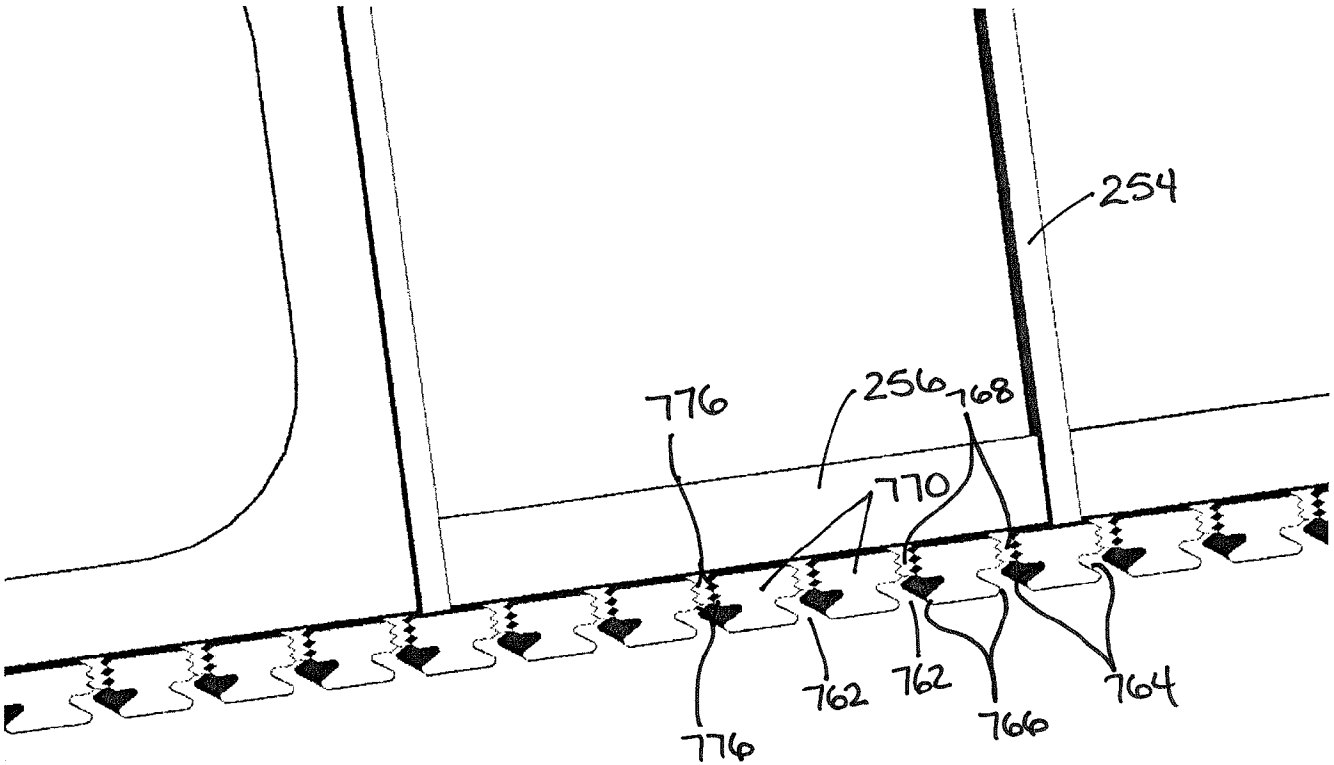
FIG. 59 is a perspective view of a fourth embodiment of mounting stud dovetails.

Referring to FIG. 59, a further embodiment of dovetails 762 is shown. The dovetails 762 each include a widened portion 764 leading to a neck portion 766 of the angled surface extending from the outer edge of the widened portion 764 to the neck 766. A slot 768 extends upward from the dovetail widened portion 764 towards the first mounting portion 252. I-beam type profile portions 770 are between and define the dovetails 762 and slot 768. The slots 768 each include parallel channels extending inward in a sawtooth type configuration defining parallel ridges to provide additional gripping surfaces for receiving and interlocking with adhesive.

Figure 78:
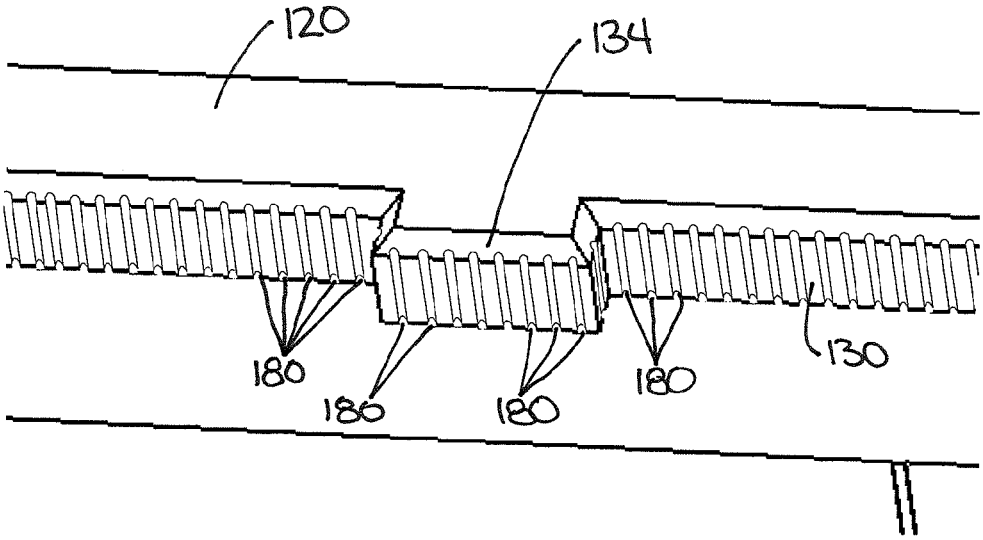
FIG. 78 shows a perspective view of an alternate embodiment of a top alignment notch with vertical channels formed in the panel.
Figure 79:
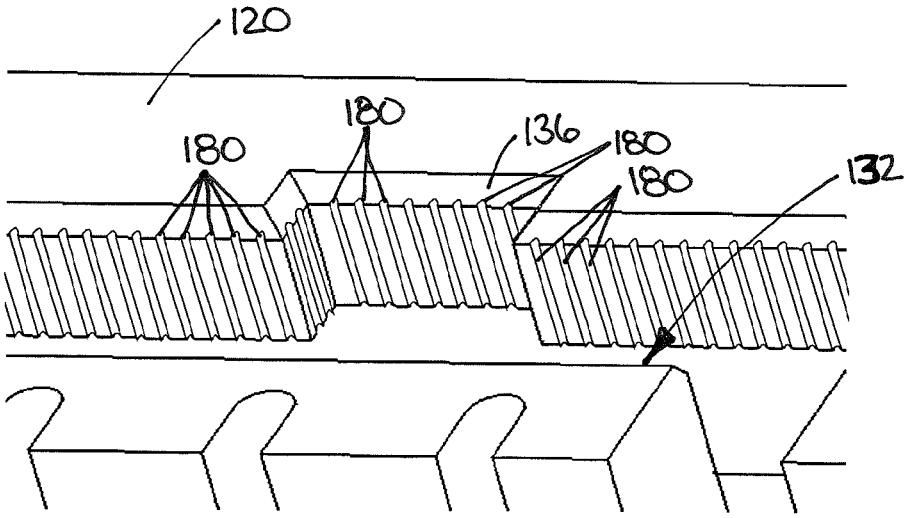
FIG. 79 shows a perspective view of an alternate embodiment of a bottom alignment notch with vertical channels formed in the panel.

Referring to FIGS. 78 and 79, the panels 120 may include vertical channels 180 formed in the surfaces of the top tongue portion 130, the bottom groove portion 132, as well as the alignment tabs 134 and the complementary notches 136. The channels 180 provide for drainage along the entire height of the panels 120 and continuous drainage from the top to bottom of the insulation system 100 to direct moisture away from wall layers that are subject to water damage.

It can be appreciated that in all the embodiments of the mounting elements, a lightweight, easily molded structure is achieved that can be made of inexpensive, lightweight materials that have a low thermal transfer rate. The elements are easily molded into an expanded foam panel and provide various structures for providing mechanical interlocks for receiving adhesive for improved connection to the panel and attachment to a mounting surface.

Moreover, the panels 220 are of a size that is easy to transport and made of a lightweight material that provides high insulation value and provides for standard mounting. Utility lines are easily routed through the insulation layer 104 created by the panels. The panels 220 also provide for openings or channels that are configured to keep moisture away from other layers that may be damaged by moisture. No special tools are required for aligning the various panels and mounting them to one another or to the mounting surfaces. Indicia easily indicate where the mounting elements are so that additional layers may be mounted on top of the panels 220.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A substantially rectangular panel of expanded foam having a first face and a second opposite face, the panel comprising:

at least one plastic mounting element at least partially embedded into the panel; the mounting element including:

a first substantially planar portion extending in a plane parallel to the faces of the panel;

a second substantially planar portion extending in a plane parallel to the faces of the panel;

ribs extending between and perpendicular to the first portion and the second portion, the mounting element having an I-beam type cross-section through the ribs, the ribs being spaced apart and defining openings between the first portion and the second portion, with the expanded foam extending through the openings and surrounding the ribs and the first and second portions, the second portion forming mechanical interlocks opening to the second face of the panel, each of the mechanical interlocks defining a widened portion narrowing to a neck portion at one of the faces of the panel configured for receiving adhesive and interlocking with the adhesive;

connecting portions along edges of each panel for fitting edges of the panel to similar adjacent panels.

2. A panel according to claim 1, further comprising indicia on the first face of the panel aligned with the first portions of the mounting elements.

3. A panel according to claim 2, wherein the indicia comprise first markings aligned with mounting elements spaced apart a first distance and second markings spaced apart a second distance.

4. A panel according to claim 1, further comprising alignment notches and complementary tab portions configured for aligning with the notches of an adjacent panel.

5. A panel according to claim 1, wherein the neck portions are spaced apart along the second portion in a side by side arrangement.

6. A panel according to claim 5, wherein the second portion defines slots extending parallel to each neck portion.

7. A panel according to claim 5, further comprising a plurality of slots formed in a first edge of the second portion and extending transverse to a longitudinal direction of the mounting element.

8. A panel according to claim 7, wherein each of the slots extends into an opening defined by a corresponding neck portion.

9. A panel according to claim 5, further comprising a slot extending upward from each of the mechanical interlocks through the second portion.

10. A panel according to claim 9, wherein the slot includes sides having a plurality of ridges.

11. A panel according to claim 5, wherein locations intermediate adjacent neck portions at a side of the second portion at which the neck portions open each include a channel extending intermediate adjacent neck portions.

12. A panel according to claim 1, wherein the connecting portion of a first edge defines a groove and the connecting portion of a second edge defines a complementary tongue.

13. A panel according to claim 12, wherein the first edge defines a first water channel extending in the edge on a first side of the tongue and a second water channel on a second side of the tongue.

14. A panel according to claim 1, wherein flanges extend around a central opening formed by two adjacent ribs.

15. A panel according to claim 14, wherein the flanges form a border around the central opening.

16. A panel according to claim 1, wherein the panel comprises a plurality of parallel spaced apart mounting elements.

17. A panel according to claim 1, wherein the neck portion has angled sides extending inward to the widened portion.

18. An insulation system, comprising:

a plurality of rectangular expanded foam panels configured for attaching to a mounting surface, each of the panels having a first face and a second opposite face, the panels fitting together to form an extended insulation layer, each of the panels comprising:

at least one plastic mounting element at least partially embedded in the panel; the mounting element including:

a first substantially planar portion extending in a plane parallel to the faces of the panel;

a second substantially planar portion extending in a plane parallel to the faces of the panel;

ribs extending between the first portion and the second portion and defining openings there between, the expanded foam extending through the openings and surrounding the ribs and the first and second portions, the second portion forming mechanical interlock portions configured to receive adhesive for mounting the panel to the mounting surface and defining neck portions interlocking with the adhesive when cured;

connecting portions along edges of each panel for fitting edges of the panel to adjacent panels.

19. An insulation system according to claim 18, wherein the mounting element is recessed from the first face.

20. An insulation system according to claim 18, wherein a portion of the mounting element extends outward beyond a plane of the first face.

21. An insulation system according to claim 18, wherein the connecting ribs extend along a length of the mounting element from a midpoint of a width of the first mounting portion and of the second mounting portion.

22. An insulation system according to claim 18, wherein the mechanical interlock has angled sides extending inward from the neck portion to the widened portion.

23. A substantially rectangular panel of expanded foam having a first face and a second opposite face and four edges, the panel comprising:

connecting portions along the edges of each panel for fitting edges of the panel to adjacent panels;

an elongated plastic mounting element at least partially embedded in the panel, the mounting element comprising:

a first mounting portion extending in a plane substantially parallel to the faces of the panel;

a second mounting portion extending in a plane substantially parallel to the faces of the panel;

connecting ribs extending between the first mounting portion and the second mounting portion and substantially perpendicular to the faces of the panel, the connecting ribs defining openings there between, the expanded foam extending through the openings and surrounding the ribs, the second portion forming mechanical interlock portions defining neck portions opening to one of the faces of the panel and configured to receive and form a mechanical interlock with adhesive;

wherein the connecting portion of a first one of the edges defines a tongue and the connecting portion of a second one of the edges defines a complementary groove, and wherein the first ones of the edges defines a first water channel extending in the first one of the edges on a first side of the tongue and a second water channel on a second side of the tongue; and wherein the second face defines chases configured for receiving utility lines extending along the panel.

24. A panel according to claim 23, further comprising indicia on the first face of the panel aligned with the first substantially planar portions of the mounting elements.

25. A panel according to claim 23, further comprising alignment notches and complementary tab portions configured for aligning with the notches of an adjacent panel.

26. A panel according to claim 23, wherein the water channel extends along a length of the first edge.

27. A panel according to claim 23, wherein the tongue includes a chamfered corner to create a channel when fitted against a groove.

28. A panel according to claim 23, wherein the groove defines a longitudinal recessed channel creating a channel when engaged by a tongue.

29. A panel according to claim 23, wherein the panel defines a plurality of parallel channels extending along the second face of the panel.

30. A panel according to claim 23, wherein the panel further defines a chase extending within the panel extending from the top to the bottom of the panel.

31. A panel according to claim 23, wherein the panel further defines a chase extending within the panel extending substantially horizontally.

32. A panel according to claim 23, wherein the connecting portion along the top edge defines tongue with a plurality of vertical channels formed in a side of the tongue.

33. A panel according to claim 32, wherein the connecting portion along the bottom edge defines groove complementary to the tongue of the top edge with a plurality of vertical channels formed in a side of the groove.

34. A panel according to claim 33, wherein the top edge defines an alignment tab having at least one vertical channel formed therein.

35. A panel according to claim 34, wherein the bottom edge defines an alignment notch complementary to the alignment tab and having at least one vertical channel formed therein.

36. A panel according to claim 23, wherein the ribs extend substantially perpendicular to the faces of the panel.

37. A panel according to claim 23, wherein a cross-section of the mounting element through the first mounting portion, the second mounting portion and the ribs comprises an I-beam.

38. A panel according to claim 23, wherein the mechanical interlock has angled sides extending inward from the neck portion to the widened portion.

* * * * *